US009175918B2

(12) United States Patent
Heizer et al.

(10) Patent No.: US 9,175,918 B2
(45) Date of Patent: Nov. 3, 2015

(54) MULTIPLE BARREL SEQUENTIAL FIRING MECHANISM

(71) Applicants: Charles K. Heizer, St. Louis, MO (US); Thomas C. Heizer, St. Louis, MO (US); Timothy Wayne Groves, Barnhart, MO (US); Jacob Wayne Mahn, Bloomsdale, MO (US)

(72) Inventors: Charles K. Heizer, St. Louis, MO (US); Thomas C. Heizer, St. Louis, MO (US); Timothy Wayne Groves, Barnhart, MO (US); Jacob Wayne Mahn, Bloomsdale, MO (US)

(73) Assignee: Heizer Defense, LLC, Pevely, MO (US)

( * ) Notice: Subject to any disclaimer, the term of this patent is extended or adjusted under 35 U.S.C. 154(b) by 234 days.

(21) Appl. No.: 13/952,565

(22) Filed: Jul. 26, 2013

(65) Prior Publication Data

US 2015/0241155 A1 Aug. 27, 2015

Related U.S. Application Data

(60) Provisional application No. 61/676,870, filed on Jul. 27, 2012, provisional application No. 61/676,871, filed on Jul. 27, 2012.

(51) Int. Cl.

| | |
|---|---|
| ***F41A 3/00*** | (2006.01) |
| ***F41A 19/23*** | (2006.01) |
| ***F41A 19/14*** | (2006.01) |
| ***F41A 19/10*** | (2006.01) |

(52) U.S. Cl.

CPC ..... *F41A 19/23* (2013.01); *F41A 19/10* (2013.01); *F41A 19/14* (2013.01)

(58) Field of Classification Search

USPC ..... 42/42.01, 42.03, 69.01; 89/1.41

See application file for complete search history.

(56) References Cited

U.S. PATENT DOCUMENTS

| | | | | |
|---|---|---|---|---|
| 28,460 | A | 5/1860 | Elliot | |
| 51,440 | A | 12/1865 | Elliot | |
| 982,152 | A | 1/1911 | Marble | |
| 1,018,759 | A | 2/1912 | Hamersly | |
| 1,348,035 | A * | 7/1920 | Mossberg | 42/8 |
| 1,898,255 | A | 2/1933 | Miller | |
| 2,095,525 | A | 10/1937 | Mariano | |
| 2,568,556 | A | 9/1951 | Morrone | |
| 2,711,042 | A | 6/1955 | Simmons | |
| 3,016,645 | A | 1/1962 | Miller | |
| 3,421,243 | A | 1/1969 | Browning | |
| 3,579,891 | A | 5/1971 | Kuzma | |
| 4,315,377 | A | 2/1982 | Jenkins | |
| 4,345,397 | A | 8/1982 | Hartman | |
| 4,400,900 | A | 8/1983 | Hillberg | |
| 4,407,085 | A | 10/1983 | Hillberg | |
| 4,545,143 | A | 10/1985 | Schultz | |
| 4,625,443 | A | 12/1986 | Beretta | |
| 4,722,148 | A * | 2/1988 | Walker | 42/69.01 |
| 5,349,773 | A | 9/1994 | Sprangers | |
| 6,460,281 | B1 | 10/2002 | Schaeffer | |
| 8,495,831 | B1 * | 7/2013 | Kohout | 42/8 |

* cited by examiner

*Primary Examiner* — J. Woodrow Eldred

(74) *Attorney, Agent, or Firm* — CreatiVenture Law, LLC; Dennis J M Donahue, III

(57) ABSTRACT

A triggering mechanism suitable for sequential firing of ammunition from a firearm, wherein the firearm has multiple barrels, preferably two barrels, and the triggering mechanism allows the firing of ammunition sequentially from one barrel, then the second barrel.

20 Claims, 25 Drawing Sheets

MULTIPLE BARREL SEQUENTIAL FIRING MECHANISM

CROSS-REFERENCE TO RELATED APPLICATIONS

This application claims the benefit of provisional application Ser. No. 61/676,870 filed Jul. 27, 2012, and provisional application Ser. No. 61/676,871 filed Jul. 27, 2012, which are hereby incorporated by reference.

STATEMENT REGARDING FEDERALLY SPONSORED RESEARCH

Not Applicable.

APPENDIX

Not Applicable.

BACKGROUND OF THE INVENTION

1. Field of the Invention

The present invention relates to a trigger mechanism, and more particularly to a trigger mechanism for a firearm having multiple barrels.

2. Related Art

Examples of known trigger mechanisms for multiple barrel firearms are described in the references listed below.

BRIEF DESCRIPTION OF THE DRAWINGS

The present invention will become more fully understood from the detailed description and the accompanying drawings, wherein:

FIGS. 1A-1I are cross-sectional views of a firearm with a progression for the cocking, indexing, release and return of a first embodiment of the trigger mechanism of the present invention.

SUMMARY OF THE INVENTION

Figure 1A:
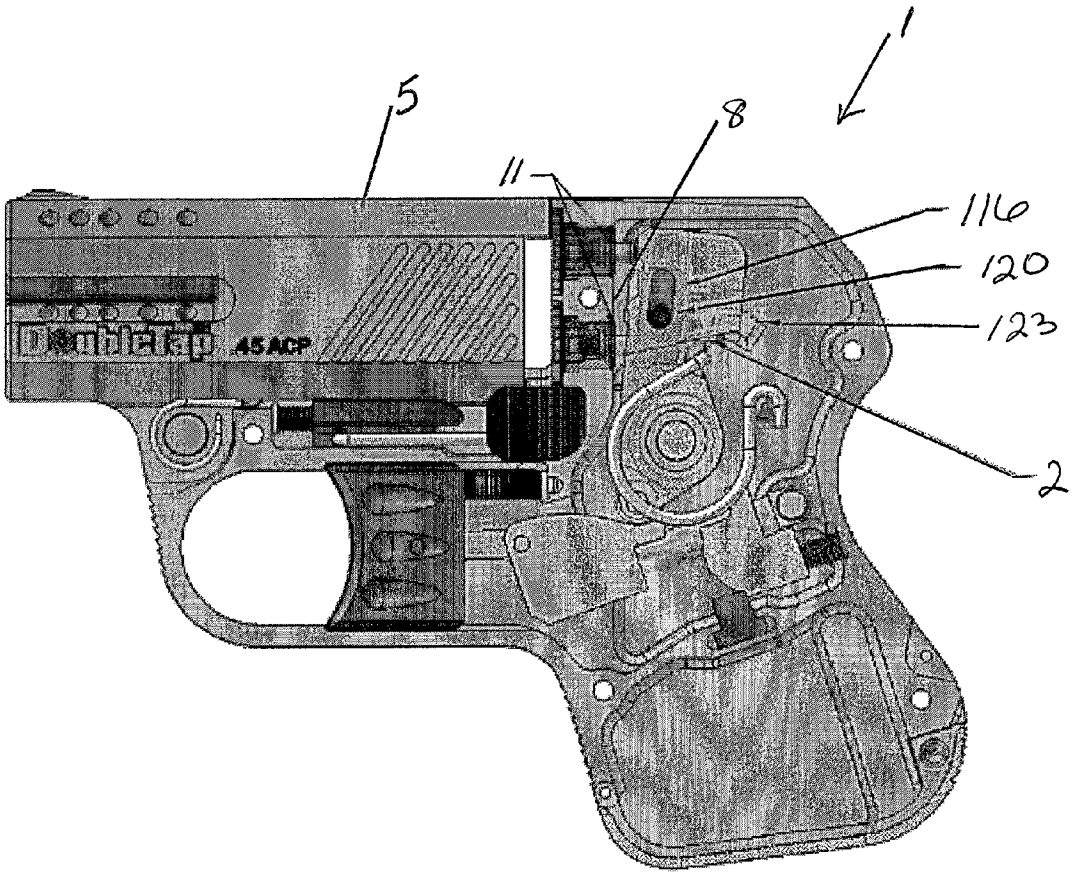
Figure 1B:
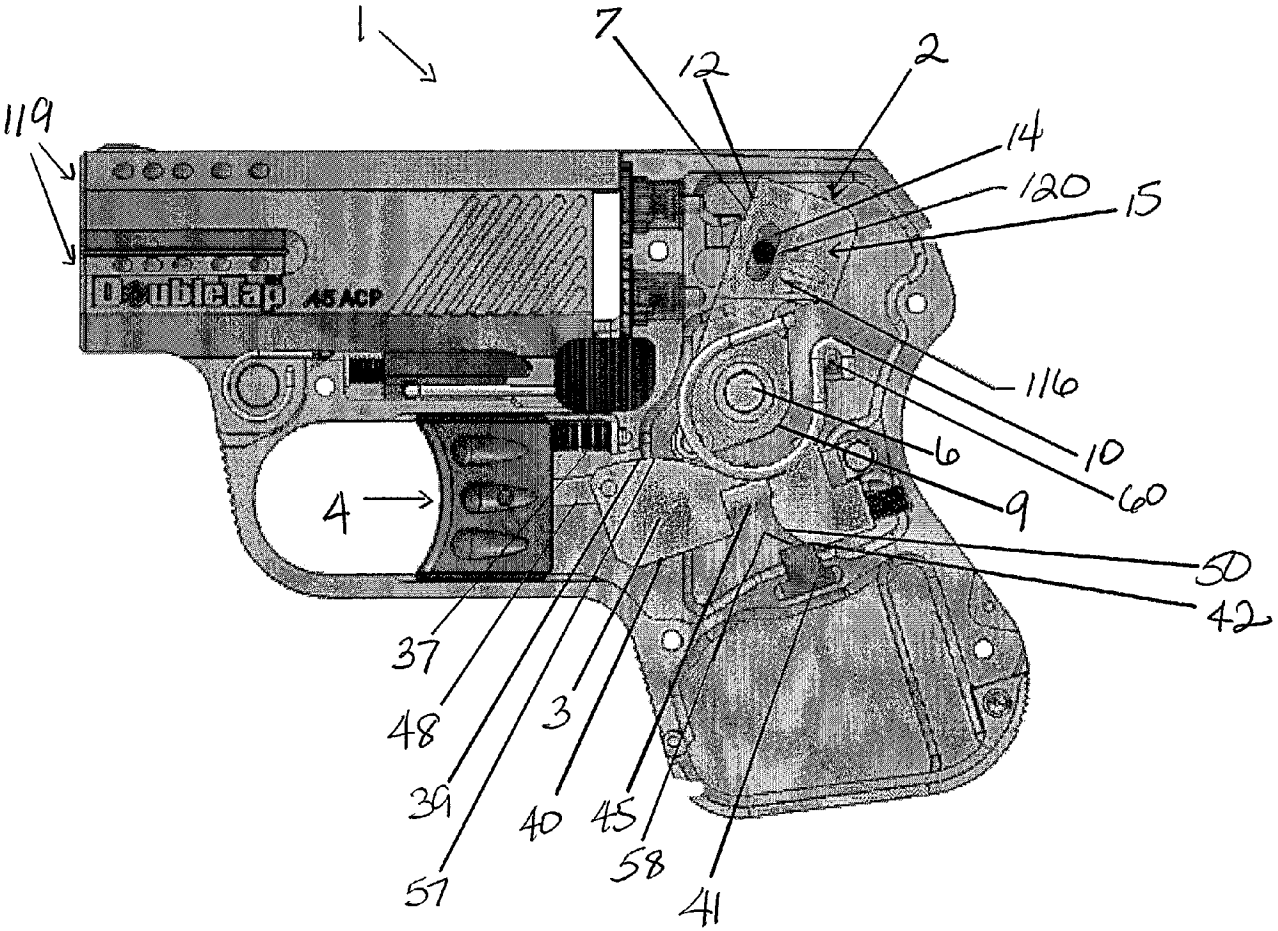
Figure 1C:
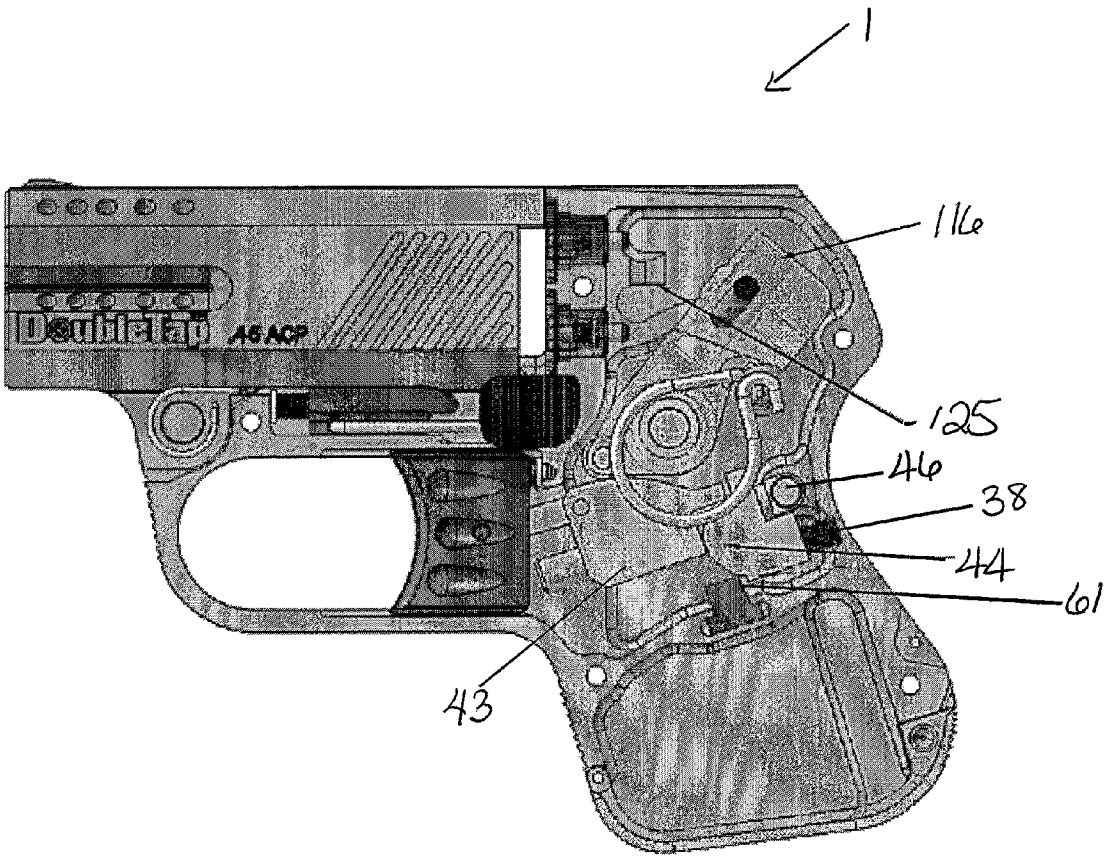

The present invention is a triggering mechanism suitable for sequential firing of ammunition from a firearm, wherein the firearm has multiple barrels, preferably two barrels, and the triggering mechanism allows the firing of ammunition sequentially from one barrel, then the second barrel.

DETAILED DESCRIPTION OF THE PREFERRED EMBODIMENTS

The following description of the preferred embodiment(s) is merely exemplary in nature and is in no way intended to limit the invention, its application, or uses.

The trigger mechanism of the present invention is preferably used for firearms. As will be appreciated from the description below and corresponding drawings, the unique features and arrangements of the trigger mechanism could be used for actuating and triggering devices other than firearms.

In a first and second embodiment, as shown in FIGS. 1 and 2, and 5 and 6, respectively, the trigger mechanism 10 is fixed within the frame of a firearm 1. In particular, a hammer 2, sear assembly 3 and trigger pull 4 are positioned in a pistol frame 5. The hammer has a pivot point 6 between a distal striking end 7 that extends towards the breech plate 8 and a cam end 9 that contacts the sear 3. A hammer spring 10 biases the hammer in a seated position 100 against the breech plate as shown in FIG. 5A. The sear assembly 3 and trigger pull 4 operate in combination with each other and to rotate the hammer into its cocked position 200 (see FIG. 5D) and to release the hammer so that the hammer spring snaps it back in a striking action against the spring-loaded firing pins 11 in the breech plate.

In a first embodiment, as shown in detail in FIG. 2, the hammer extends from a pivot point to a distal striking end 7 and has a hollow core 15 and an exterior face 12. A pair of holes 13 and 13A extend from the exterior side to the hollow core. The holes are positioned on the hammer to be adjacent to the respective firing pins when the hammer abuts the breech plate in the seated position. The hammer also has a slot 14 on each side which extends through to the hollow core. A sequencing drum 116 is slidably fitted inside the hollow core of the hammer. As described in further detail below, the sequencing drum is moved between a lower position 117 and an upper position 118 which correspond with the firing pins for the lower barrel and upper barrel, respectively.

The sequencing drum 116 has a bore 119 and a follower pin 120 slidingly fitted within the bore so that it can slide from side to side. The follower pin extends beyond the bore and fits between the slots on either side of the hammer such that it has a right side position 121 with one end extending beyond the hammer's right side slot and a left side position 122 with the other end extending beyond the hammer's left side slot. Guide rails are formed on or otherwise fixed to opposite sides of the firearm's frame in locations that are adjacent to the slots in the hammer such the right side guide rail 123 engages the right end of the pin when the pin is in the right side position in the bore and that the left side guide rail 124 engages the left end of the pin when the pin is in the left side position in the bore. As the trigger is depressed and the hammer moves from its seated position to its cocked position, the engaging rail forces the sequencing drum between the upper and lower positions. In particular, the right guide rail engages the right end of the pin when the sequencing drum is in its lower position and the hammer is in its seated position, and as the hammer moves to its cocked position, the pin slides in the right slot as the guide rail forces the sequencing drum to its upper position. Similarly, the left guide rail engages the left end of the pin when the sequencing drum is in its upper position and the hammer is in its seated position, and as the hammer moves to its cocked position, the pin slides in the left slot as the guide rail forces the sequencing drum to its lower position.

Figure 4:
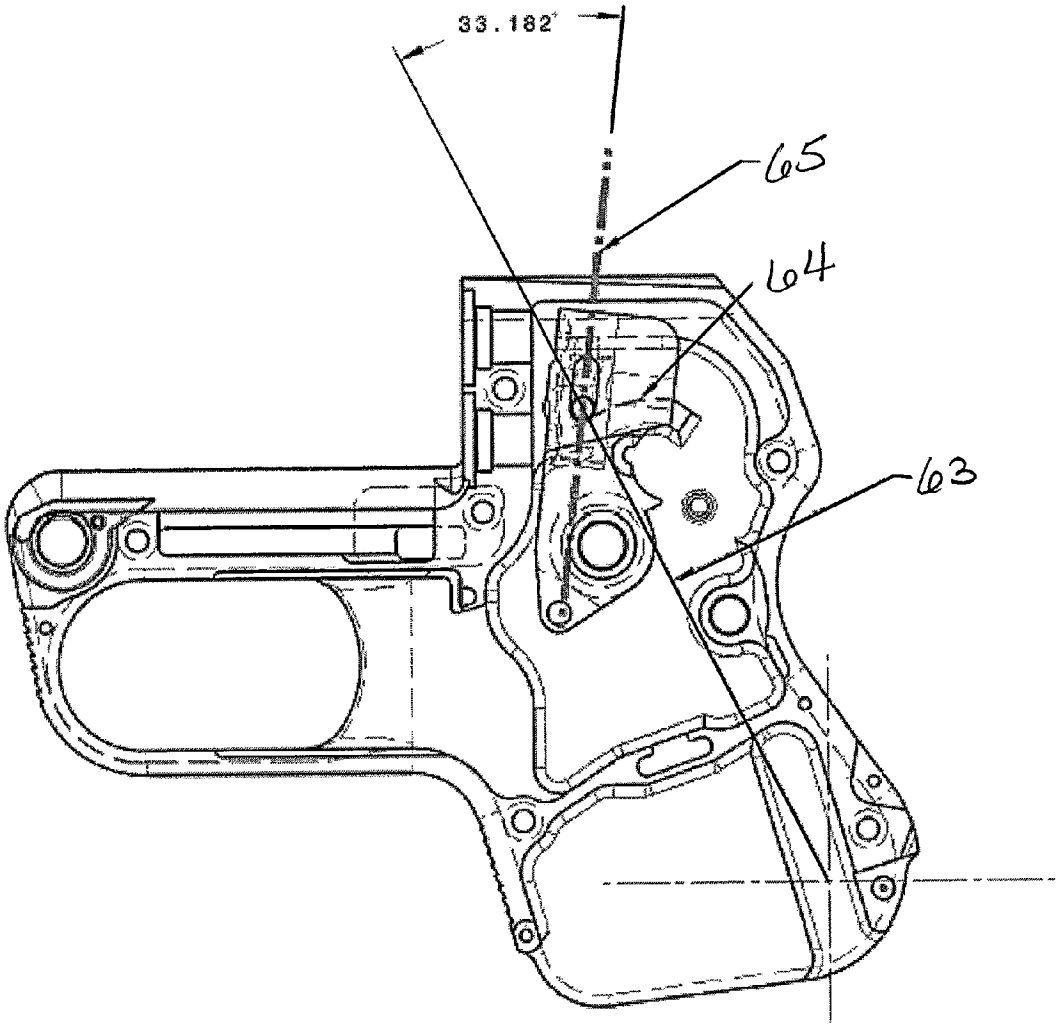
FIG. 4 illustrates the geometric relationship between the guide rails and indexing pin of a first embodiment of the present invention.

The geometry between the guide rail and the follower pin is designed to force the movement of the sequencing drum without too much friction which avoids locking-up. As shown in FIG. 4, the normal of the guide rail's curve geometry in relation to the linear movement of the follower pin preferably is kept at 36 degrees or less throughout the travel of the hammer.

The follower pin is moved between its right side position and left side positions by a pair of ramps which work in conjunction with the guide rails. As with the guide rails, the ramps are formed on or otherwise fixed to opposite sides of the firearm's frame and are located adjacent to the slots in the hammer such that the right side ramp 125 engages the right end of the pin when the pin is in the right side position in the bore and the left side ramp 126 engages the left end of the pin when the pin is in the left side position in the bore. As the hammer passes the right ramp with the sequencing drum in its upper position, the ramp pushes the follower pin from its right side position to its left side position. Similarly, as the hammer passes the left ramp with the sequencing drum in its lower position, the ramp pushes the follower pin from its left side position to its right side position. In the preferred embodiment, the follower pin is moved from side to side when the hammer snaps back from its cocked position to its seated, firing position.

The sequencing drum and follower pin preferably include detents, grooves or other indents or nubs which are used to bias the drum and pin at their indexed positions and hold them in place to keep them from sliding once they have been moved into position. The sequencing drum preferably has a pair of drum detents 127 which are fitted to a ball plunger 128 in the hammer. A portion of the ball fits into the lower detent when the drum is in the upper position fits into the upper detent when the drum is in the lower position. The follower pin further preferably has a pair of grooves 129 and the sequencing drum has its own ball plunger, and a portion of the ball fits into the left groove when the pin is in the right side position and fits into the right groove when the pin is in the left side position.

It will be appreciated that even though the firing mechanism of the present invention is particularly shown for an upper-lower barrel design, the general concept can be used for a side-by-side barrel design. In particular, for a side-by-side barrel arrangement, the sequencing drum may be positioned from side to side within a transverse hollow core in the hammer, and the guide rails could be provided along the top of the firearm's frame (not shown). In such an arrangement, the sequencing drum may have follower pins on opposite sides of the drum which are orthogonal to each other and the drum may be rotated to switch between the engaged pins (rather than using ramps to push the pins into their engaged position).

As indicated above and shown in the accompanying drawings, in the preferred embodiment of an upper-lower barrel design, the length of the sequencing drum is sized relative to the distance between the firing pins so that it is impossible for the sequencing drum to simultaneously strike both firing pins. Accordingly, the sequencing drum length is preferably shorter than the distance between the firing pins. With this design, even if the sequencing drum becomes misaligned from its detent-indexed positions, the drum may strike one of the firing pins but it cannot strike both firing pins simultaneously.

In a second embodiment, as shown in detail in FIGS. 6A-D, the hammer 2 extends from a pivot point 6 to a distal end 7 and has a hollow core 15 and a face with an exterior side 12. At least one hole, and preferably a first hole 13 and a second hole 13A extend from the exterior side to the hollow core. The holes 13 and 13A are positioned on the hammer to be adjacent to the respective firing pins 11 when the hammer abuts the breech plate in the seated position. An index pin 14 is rotatably fitted inside the hollow core 15 of the hammer. The index pin has an outer end 16 at one side of the hollow core, an inner end 17 situated within the hollow core, and a plurality of teeth 18 extending from the outer end. Preferably, the index pin has four teeth. A clocking arm 19 extends from a proximal end 21 at the frame of the firearm to a distal tip 20. The distal tip engages with the teeth as the hammer pivots from its seated position to its cocked position, thereby rotating the index pin in the hollow core. As described in further detail below, the index pin is moved between several clocked positions. Preferably, the index pin moves from a first clocked position to a second clocked position.

As particularly shown in FIGS. 6 and 7, the index pin further has a first upper chamber 22 and a second lower chamber 23. The first upper chamber has two first strike pads 24 on opposite sides of the index pin. The first upper chamber also has two first voids 27 on opposite sides of the index pin, the strike pads and voids equally spaced around the circumference of the index pin. The second lower chamber also has two second striking pads 25 and two second voids 26 equally spaced around the circumference of the pin. The strike pads of the first and second chambers are orthogonally offset. Likewise the voids of the first and second chambers are orthogonally offset, so that the side perspective of the index pin in FIG. 7A shows a first void of the upper chamber and a strike pad of the lower chamber.

A first striking pad 24 in the first upper chamber is situated proximally to the first hole 13 in the first clocked positions. A first void 27 in the first upper chamber is situated proximally to the first hole in the second clocked position. Similarly, a second striking pad 25 in the second lower chamber is situated proximally to the second hole 13A at the second clocked position. The second void 26 is situated proximally to the second hole at the first clocked position. Even though the firing mechanism of the present invention is particularly shown for an upper-lower barrel design, the general concept can be used for a side-by-side barrel design. In particular, for a side-by-side barrel arrangement, the index pin may be positioned from side to side within a transverse hollow core in the hammer, and the teeth can extend out of the side of the hammer (not shown). The clocking arm would engage the teeth accordingly.

Figure 7B:
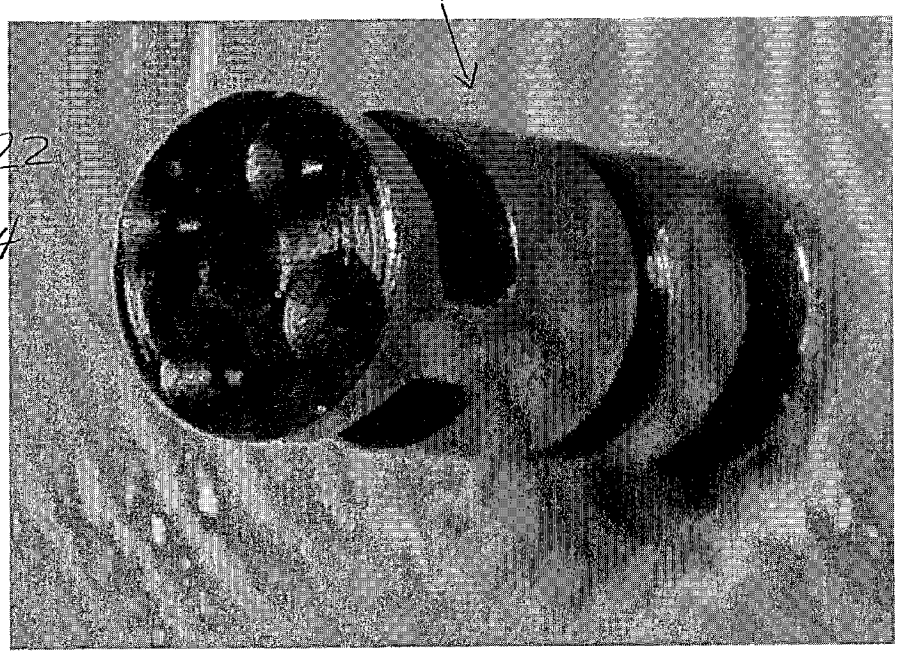
FIG. 7B is an inner end elevated perspective view of the index pin.
Figure 7D:
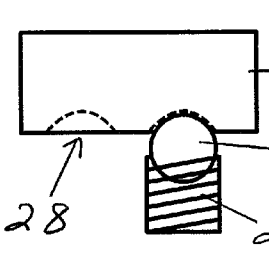
FIG. 7D is a cut away side view of the inner end of the index pin with a ball and spring.
Figure 7C:
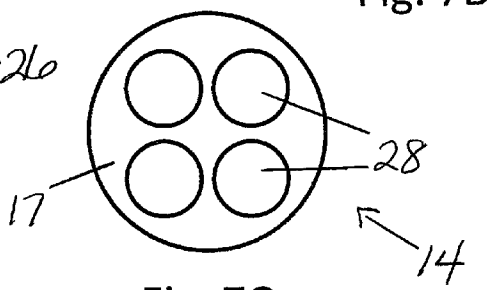
FIG. 7C is an inner end elevated perspective view of the index pin with detents.
Figure 7A:
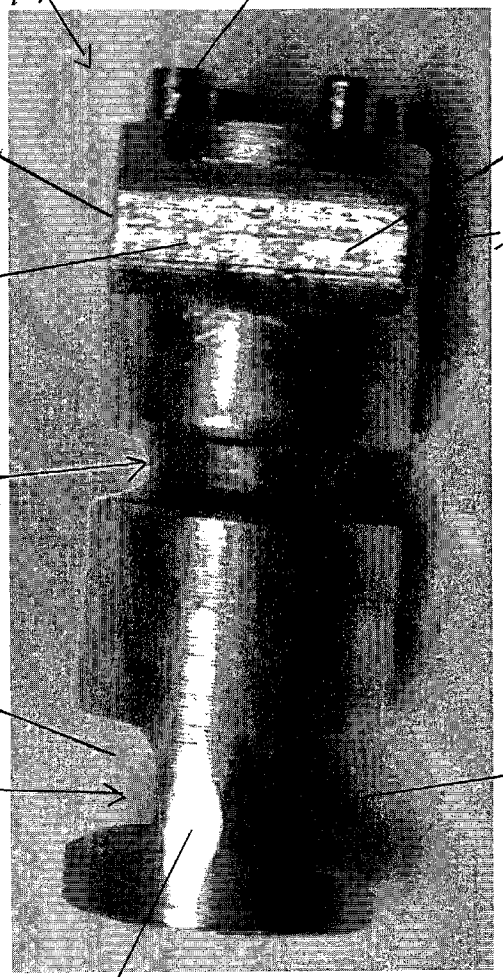
FIG. 7A is a detail side perspective view of the index pin of a second embodiment.

Regardless of the orientation of the index pin, transverse or longitudinal in the hammer, the index pin 14 preferably includes a series of detents 28 on its inner end 17 which is used to secure the index pin in each of its clocked positions (see FIG. 7C). The hammer preferably includes a spring 29 fitted in a spring recess 30 at a base of the hollow core 15, and a ball 31 is situated between the inner end 17 of the index pin and the spring, as shown in FIG. 7D. A portion of the ball fits into the detents as the index pin is rotated by the clocking arm.

The index pin also preferably has a groove 32 around its circumference between the outer and inner ends. The hammer preferably includes a pinhole 33 extending from at least one of its sides through to the hollow core 15 and a retaining pin 34 extending through the pinhole and into the groove. This retaining mechanism keeps the indexing pin securely in place within the hammer while allowing the indexing pin to rotate inside the hollow core. The clocking arm 19 is preferably angled from the proximal end 21 toward the teeth as the distal tip 20.

Figure 5A:
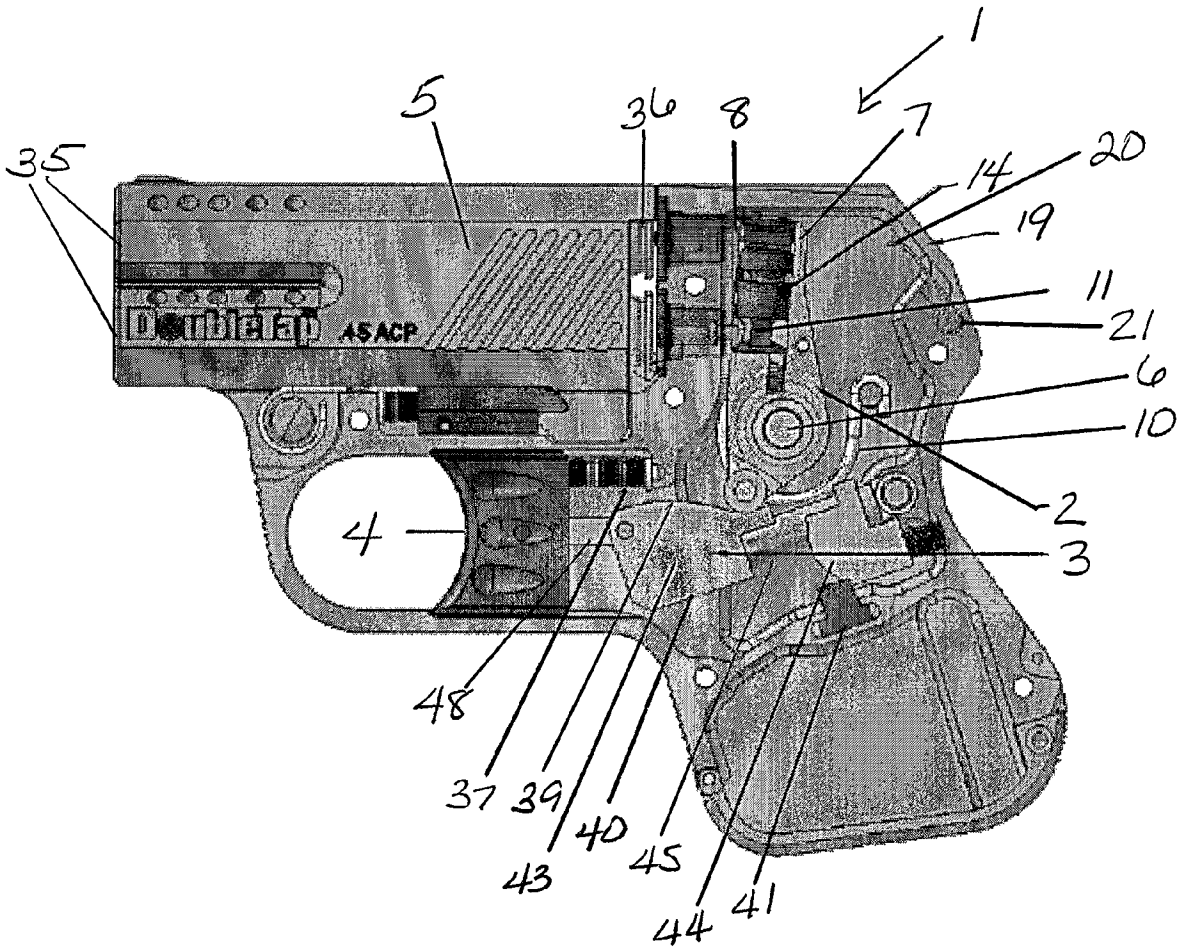
FIG. 5A is a cross-sectional view of a firearm with the trigger mechanism of a second embodiment of the present invention with the hammer in a seated position and with the index pin in a first clocked position.
Figure 5B:
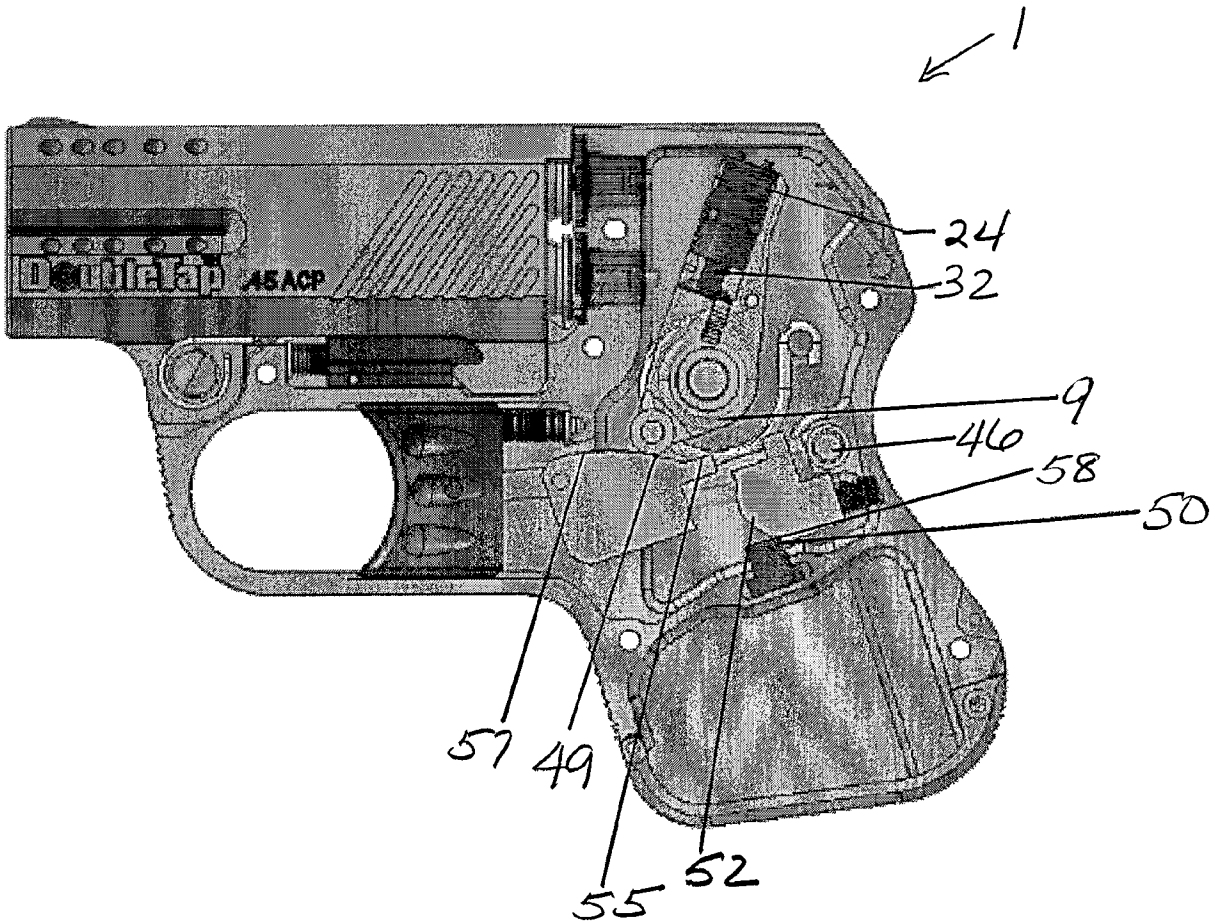
FIG. 5B is a cross-sectional view of a firearm with the trigger mechanism of a second embodiment of the present invention with the hammer in a one-third clocked position and with the index pin in a first clocked position.
Figure 5C:
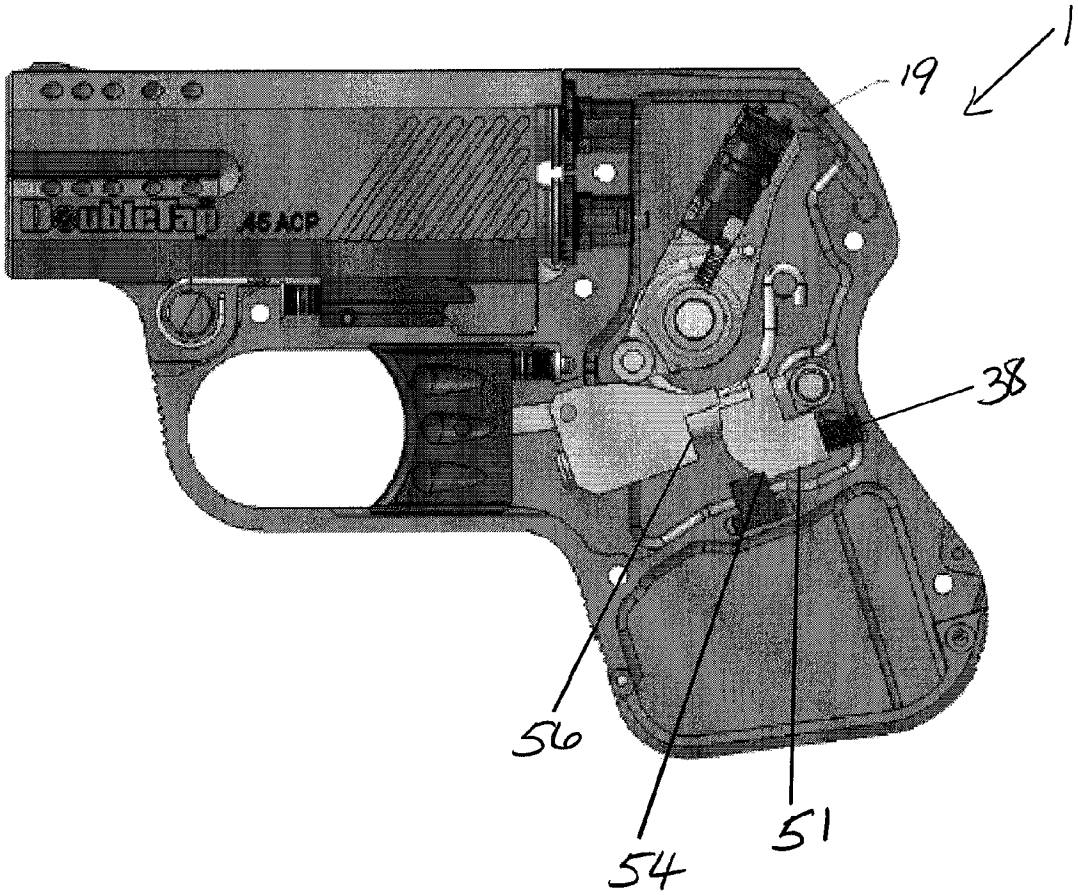
FIG. 5C is a cross-sectional view of a firearm with the trigger mechanism of a second embodiment of the present invention with the hammer in a two-third clocked position and with the index pin in a first clocked position.
Figure 5D:
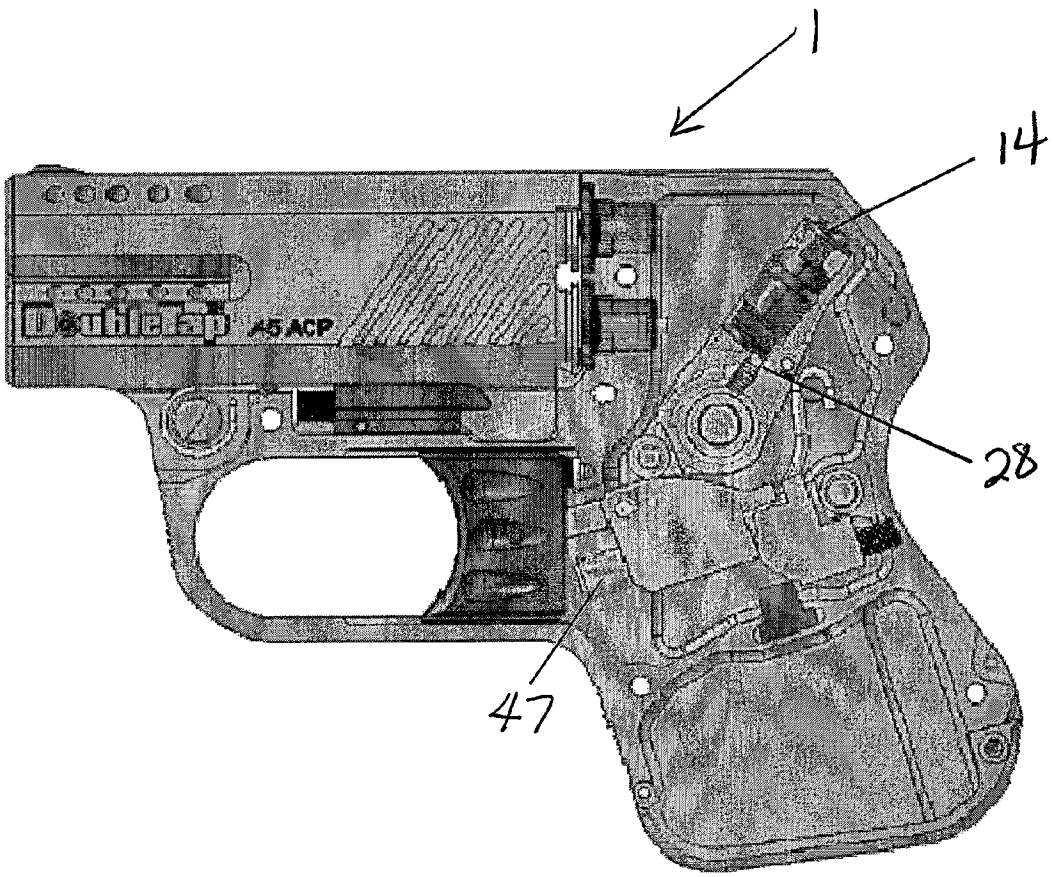
FIG. 5D is a cross-sectional view of a firearm with the trigger mechanism of a second embodiment of the present invention with the hammer in a fully clocked position and with the index pin in a second clocked position.
Figure 5E:
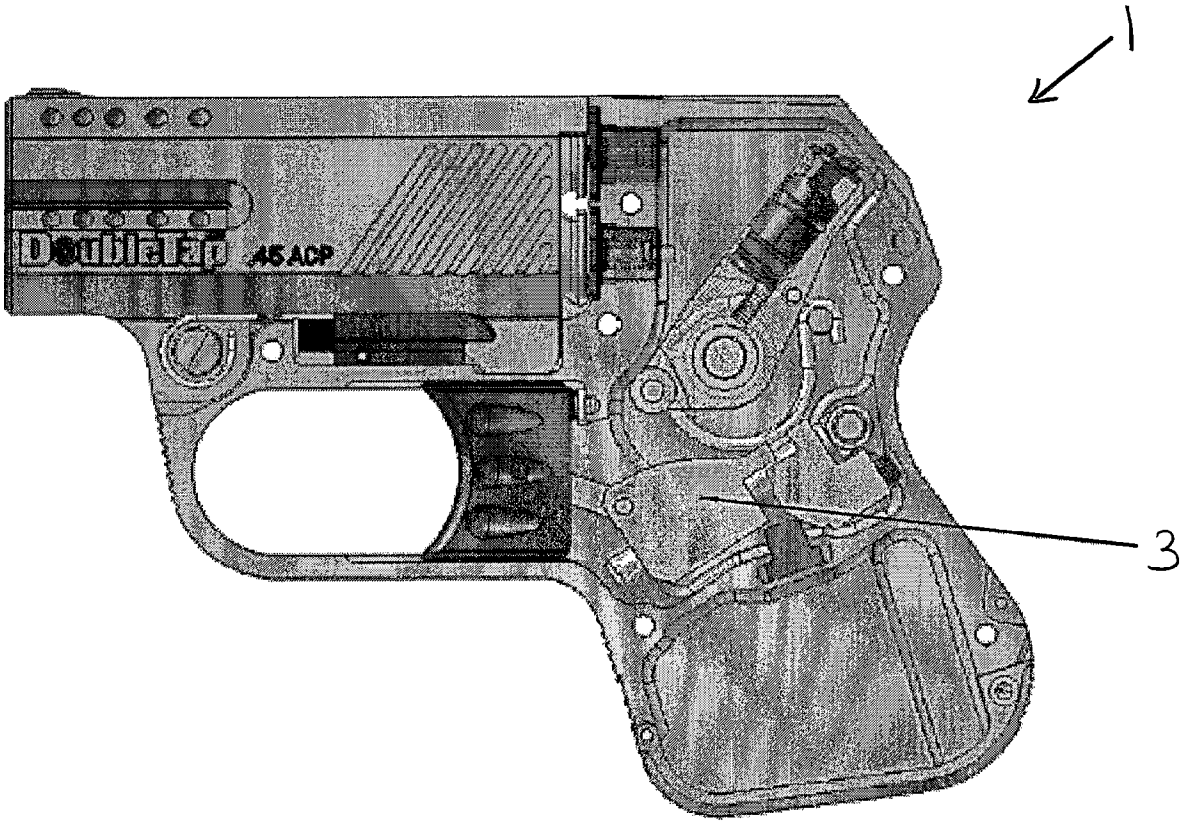
FIG. 5E is a cross-sectional view of a firearm with the trigger mechanism of a second embodiment of the present invention with the sear falling away initiating the hammer strike.
Figure 5F:
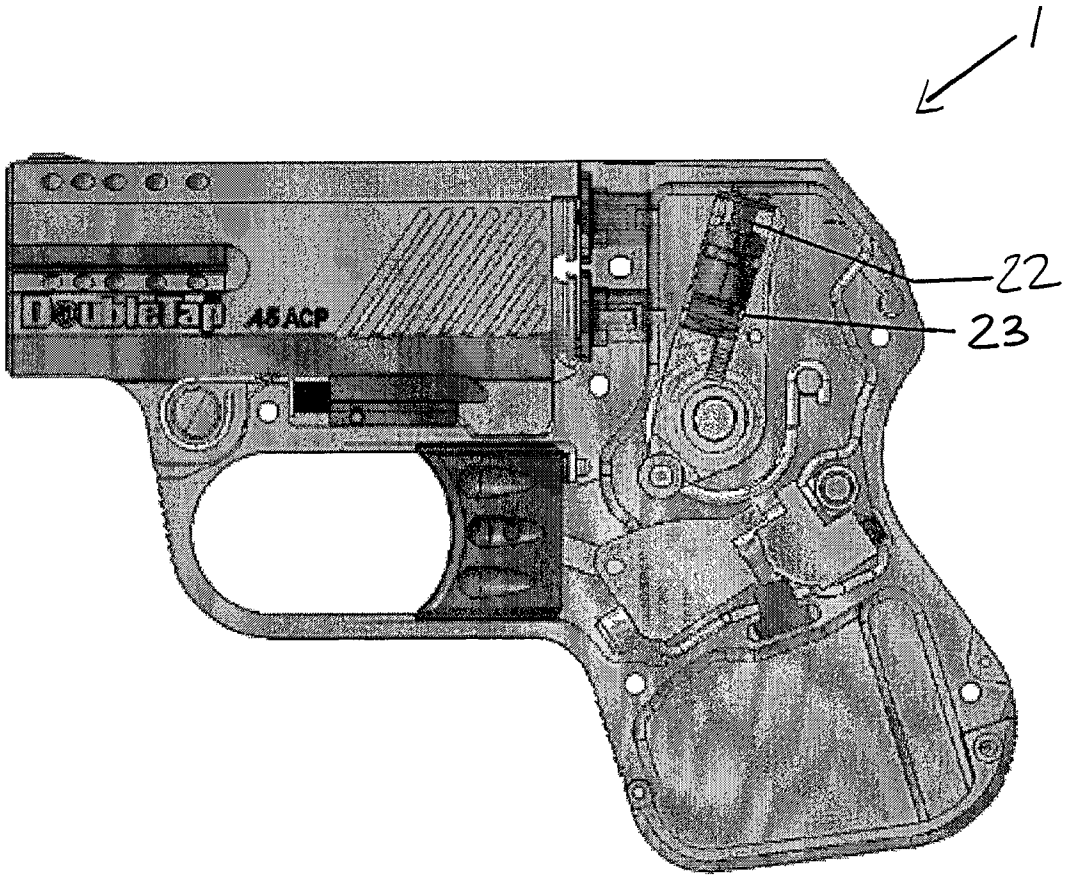
FIG. 5F is a cross-sectional view of a firearm with the trigger mechanism of a second embodiment of the present invention with the hammer in mid-strike.
Figure 5G:
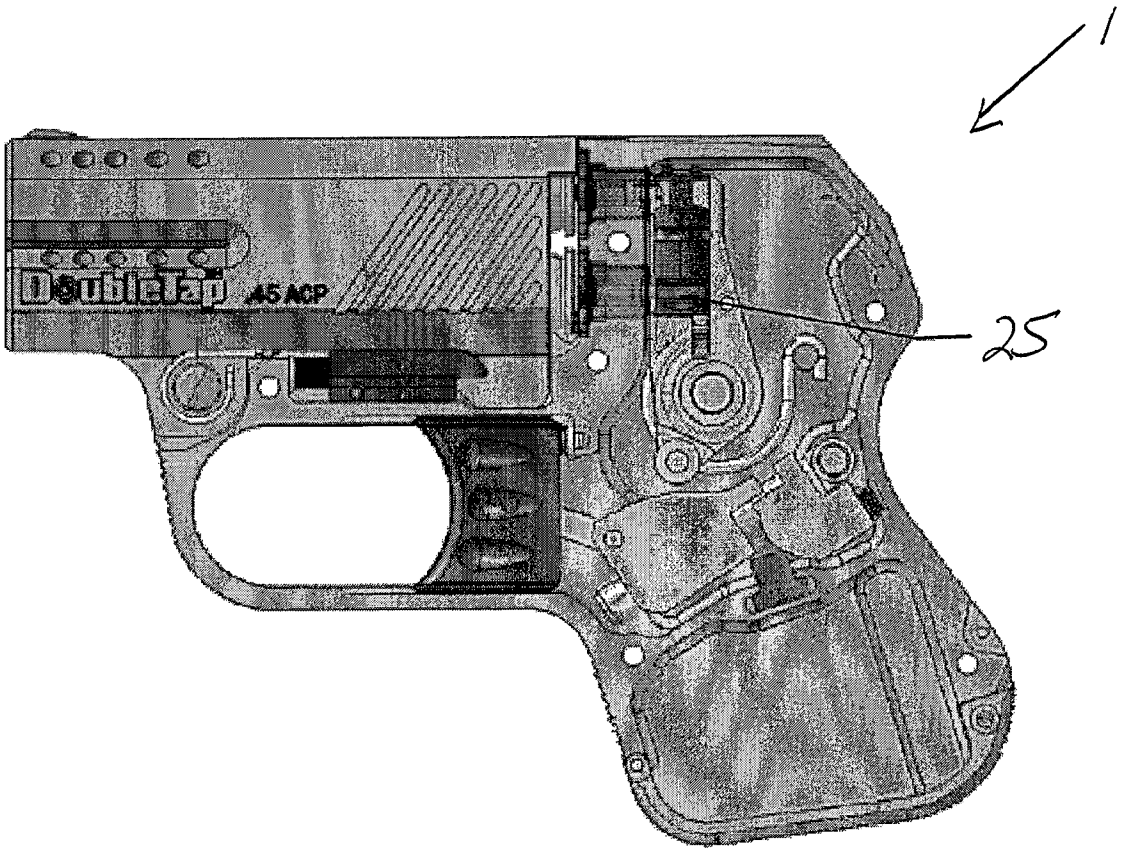
FIG. 5G is a cross-sectional view of a firearm with the trigger mechanism of a second embodiment of the present invention.
Figure 6A:
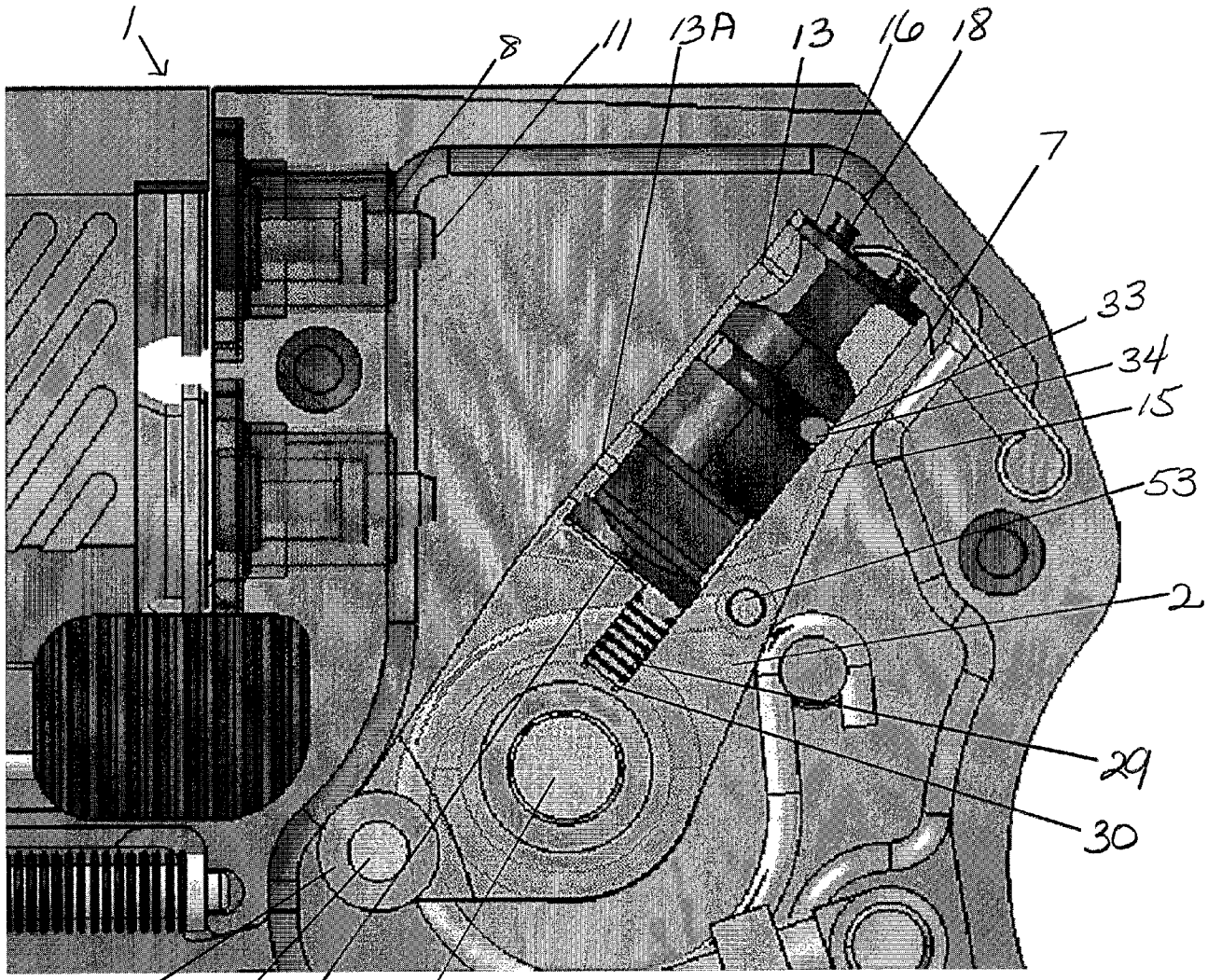
FIG. 6A is a detail view of the trigger mechanism of a second embodiment in the fully cocked position and the index pin in the second clocked position.
Figure 6B:
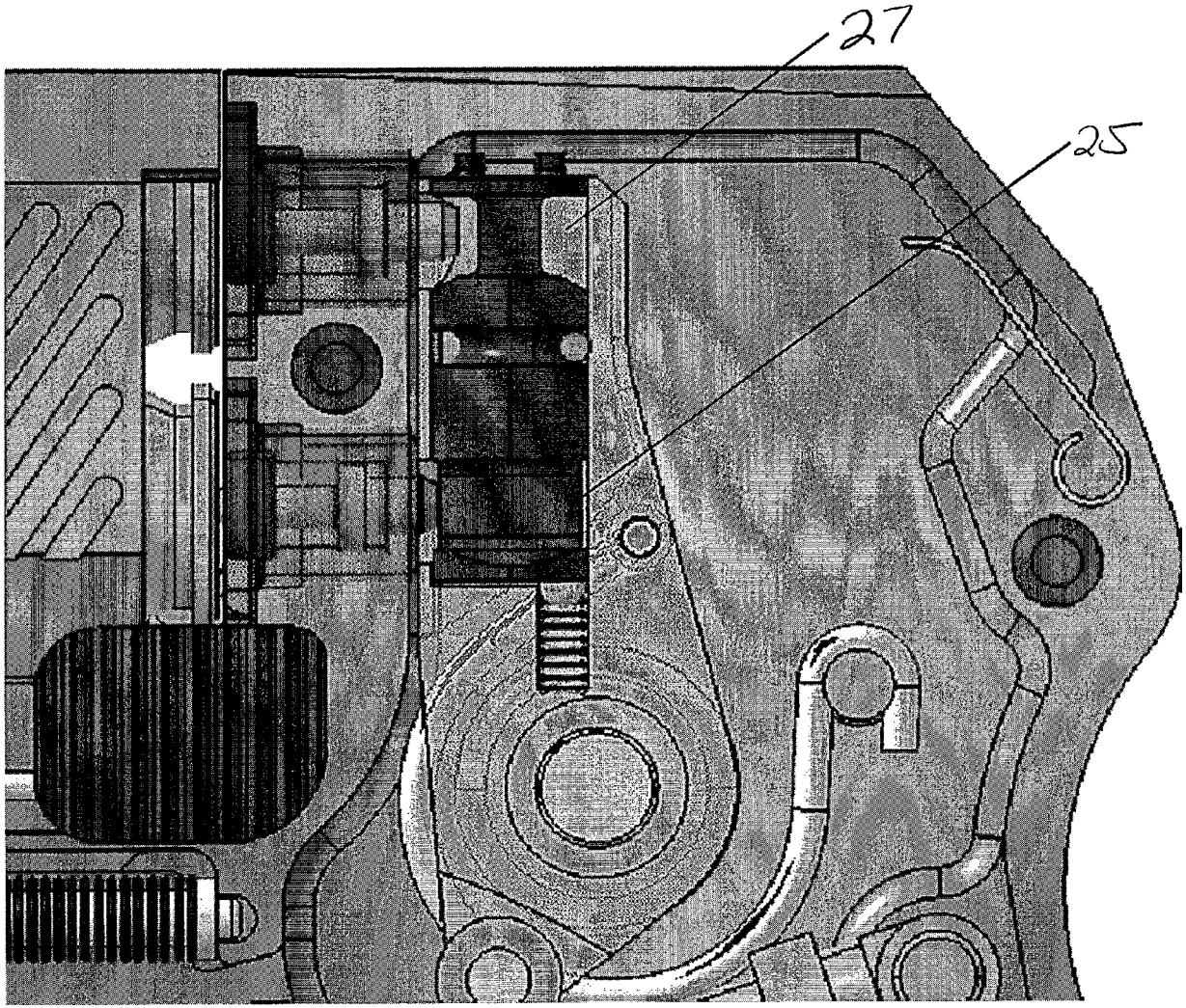
FIG. 6B is a detail view of the trigger mechanism of a second embodiment in the seated position and the index pin in the second clocked position.
Figure 6C:
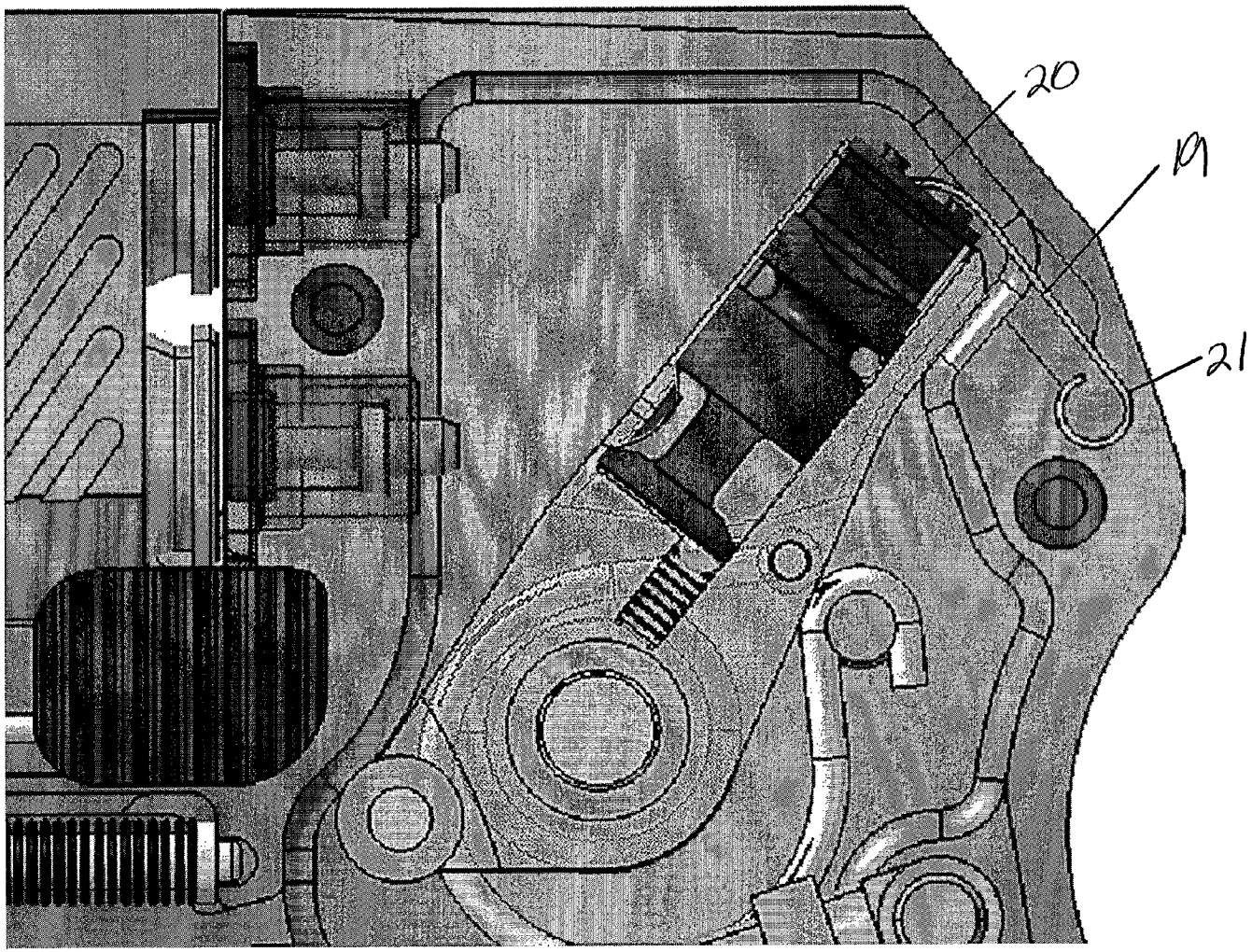
FIG. 6C is a detail view of the trigger mechanism of a second embodiment in the fully cocked position and the index pin in the first clocked position.
Figure 6D:
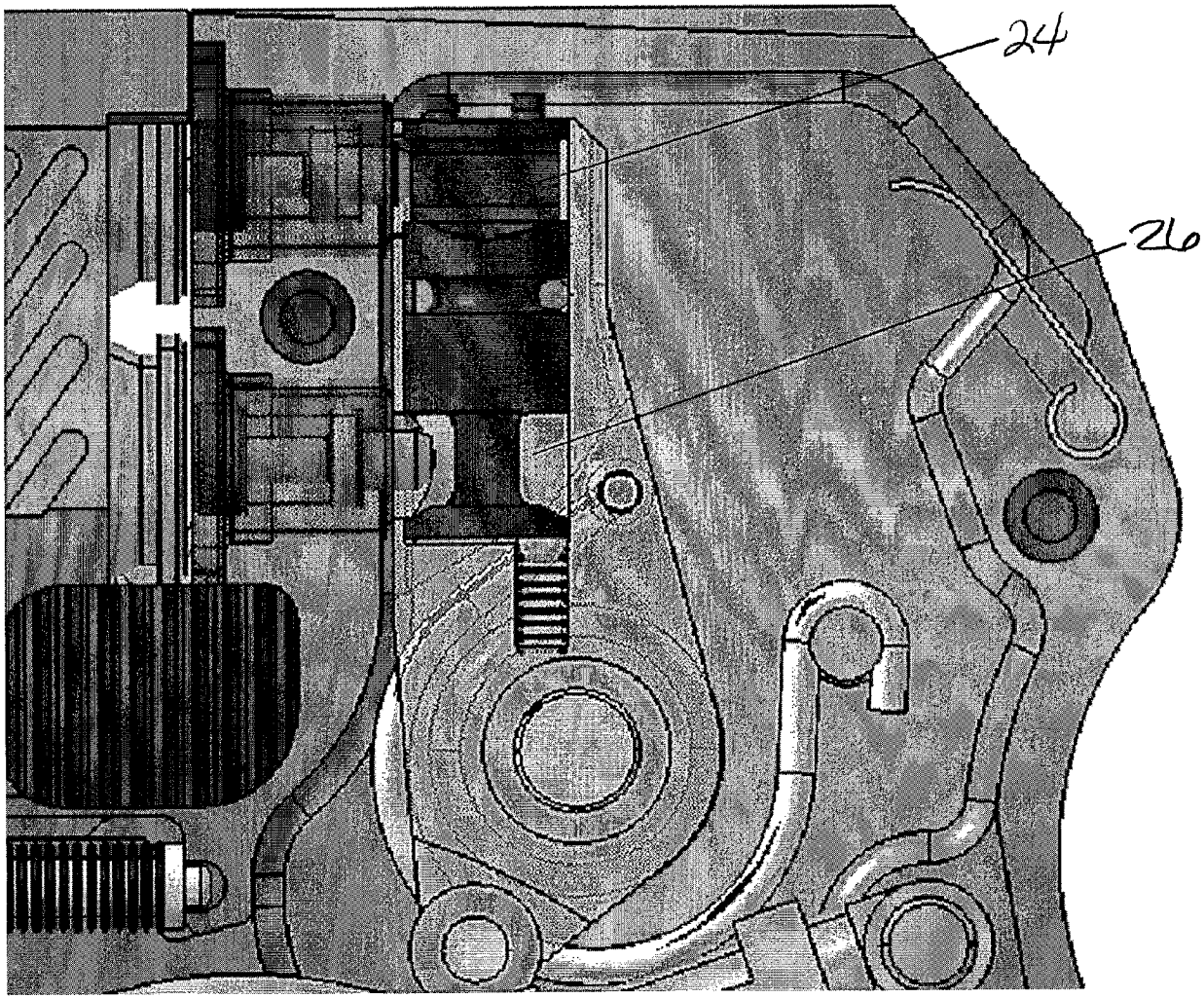
FIG. 6D is a detail view of the trigger mechanism of a second embodiment in the seated position and the index pin in the first clocked position.

As indicated above and shown in the accompanying drawings, in the preferred embodiment of an upper-lower barrel design, the outer end 16 of the index pin is situated at the distal end 7 of the hammer, and the chambers 24 and 25 are spaced along the longitudinal axis of the hammer. The pair of firing pins 11 in the breech plate 8 corresponds with the barrels 35 so that the face 12 of the hammer is situated against the breech plate when the hammer is in the seated position, as shown in FIG. 5A. The upper striking pad 24 engages one of the pair of firing pins when the index pin is the first opposing clocked position, as shown in FIG. 6D. The lower striking pad 25 engages the other of the pair of firing pins when the index pin is in the second orthogonal clocked position, as shown in FIG. 6B.

Figure 1D:
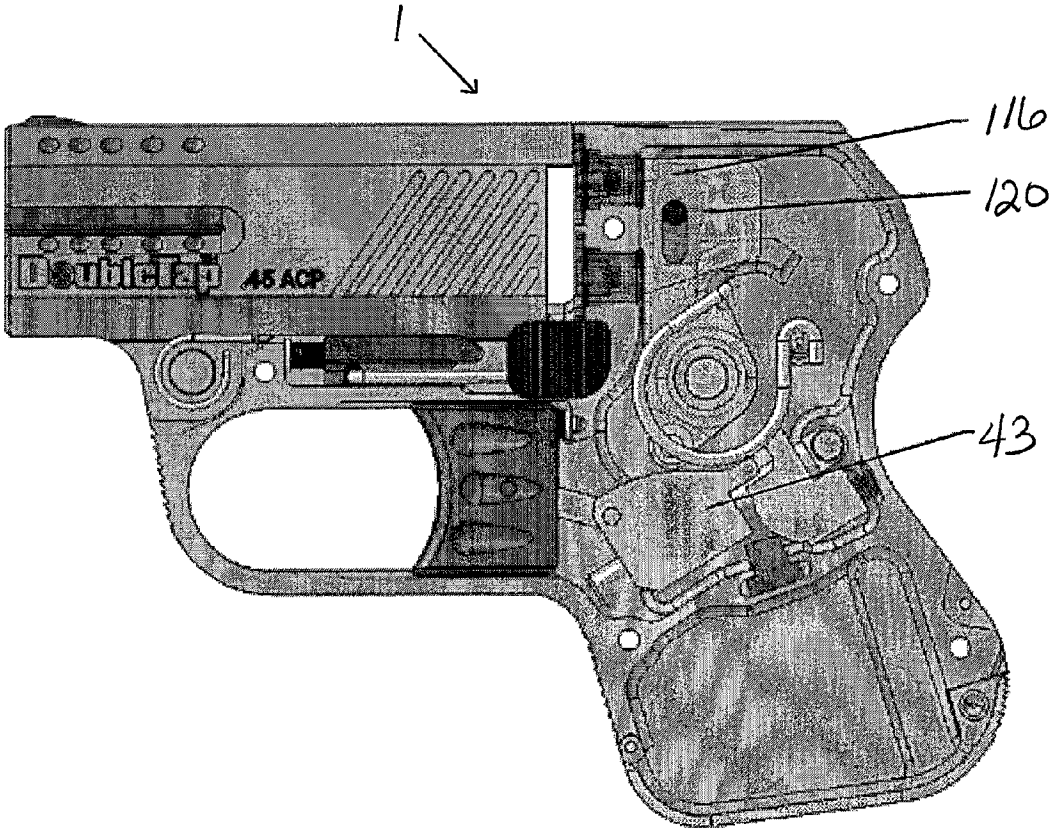
Figure 1E:
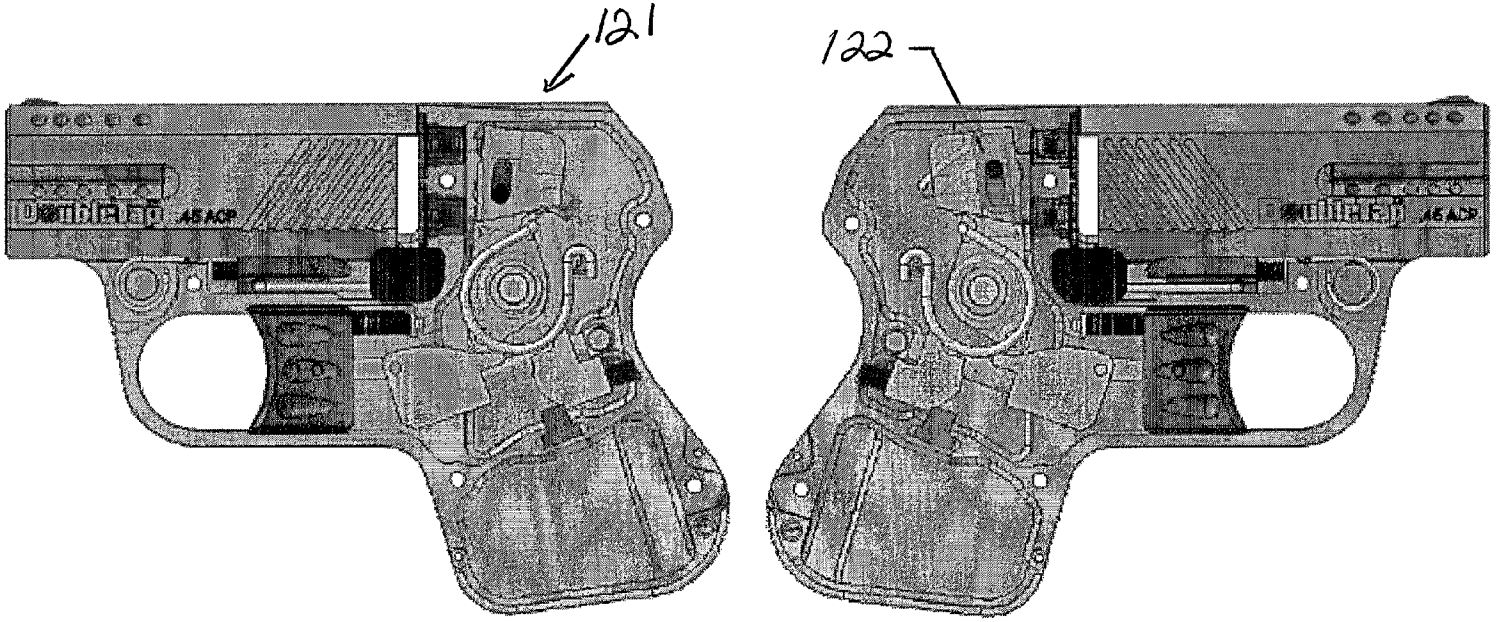
Figure 1F:
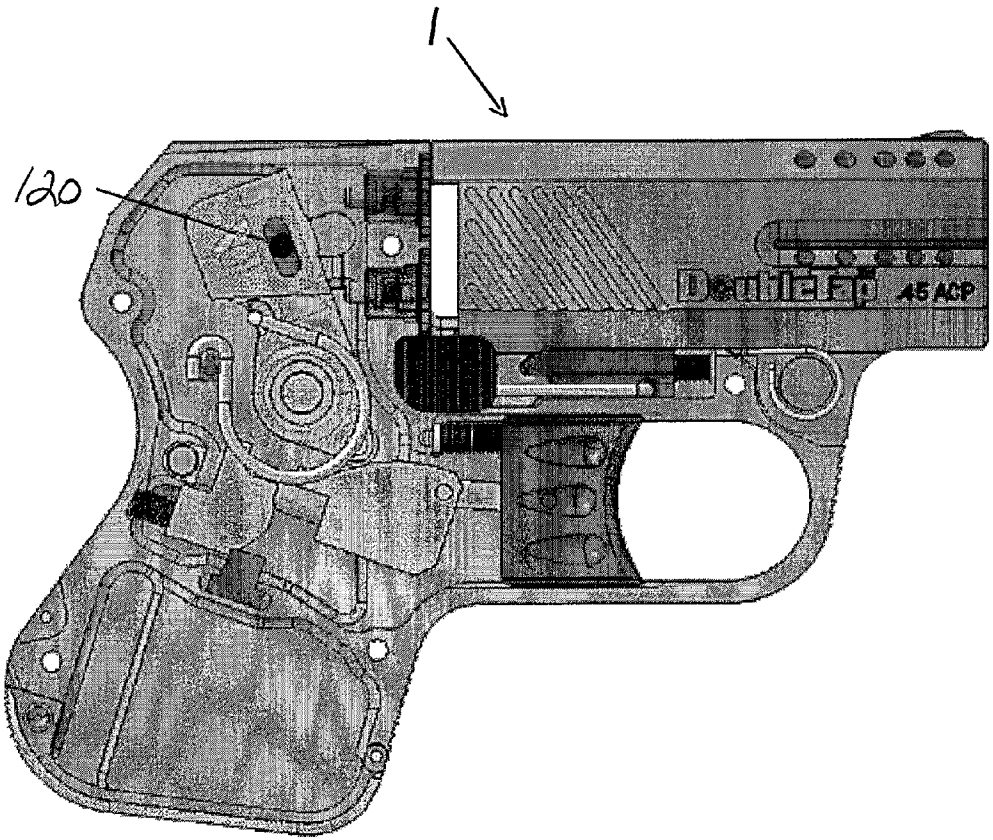
Figure 1G:
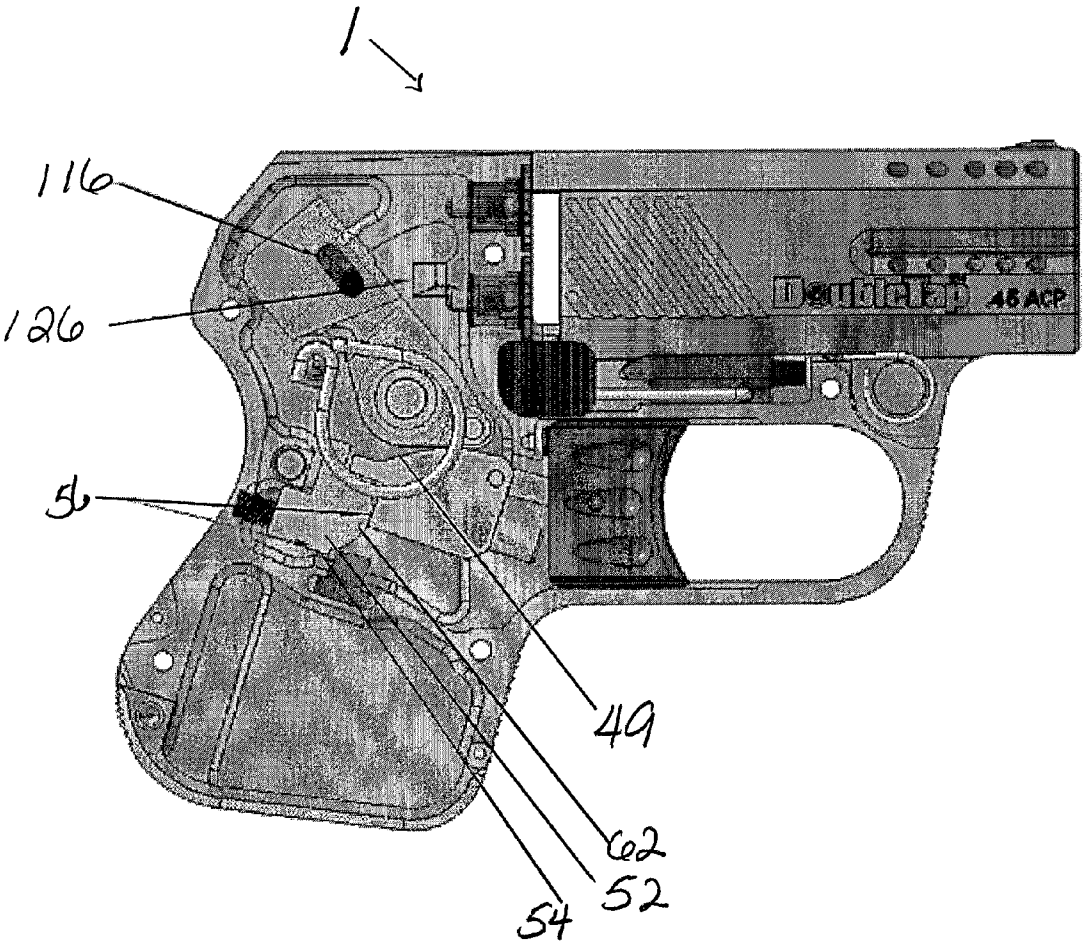
Figure 1H:
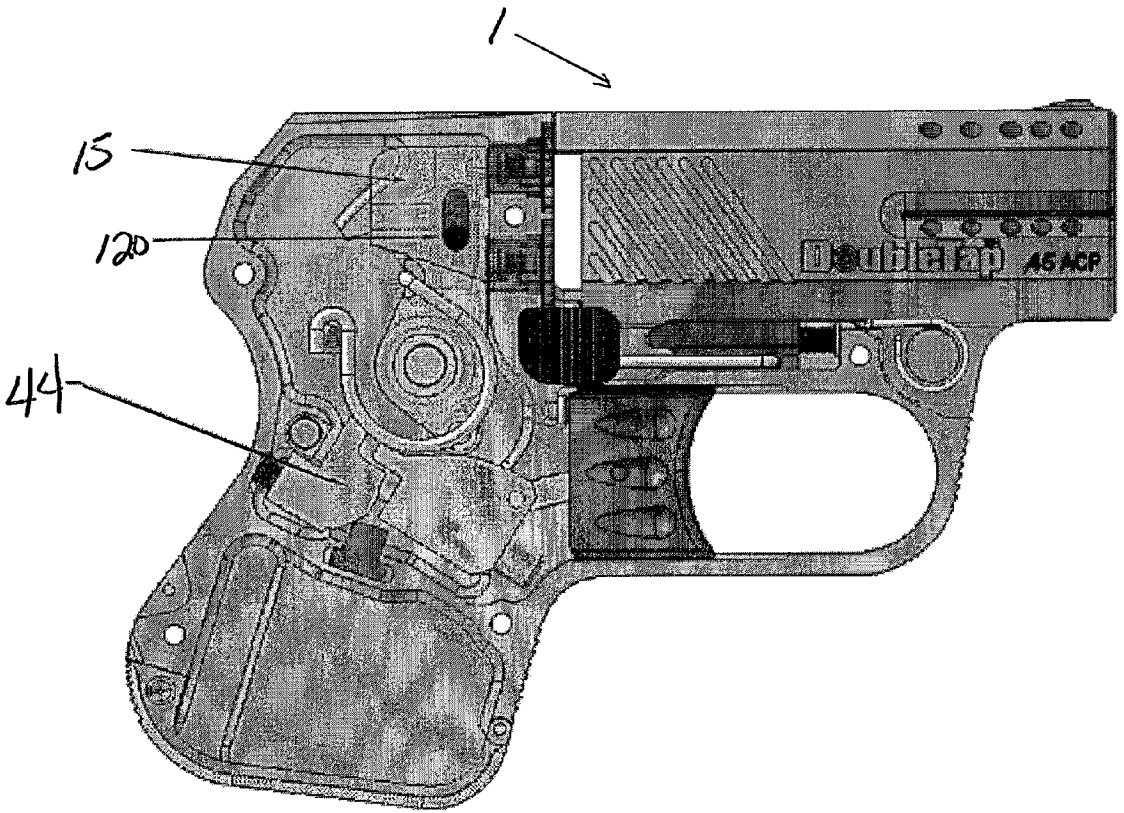
Figure 11:
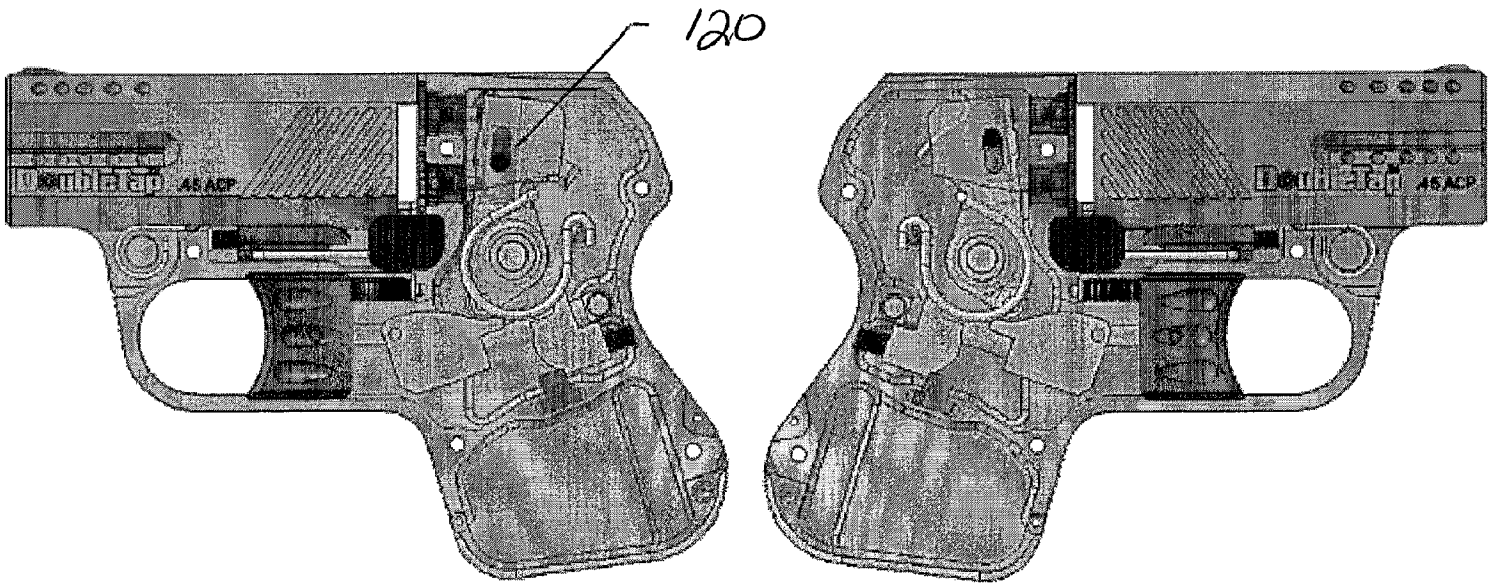
Figure 2B:
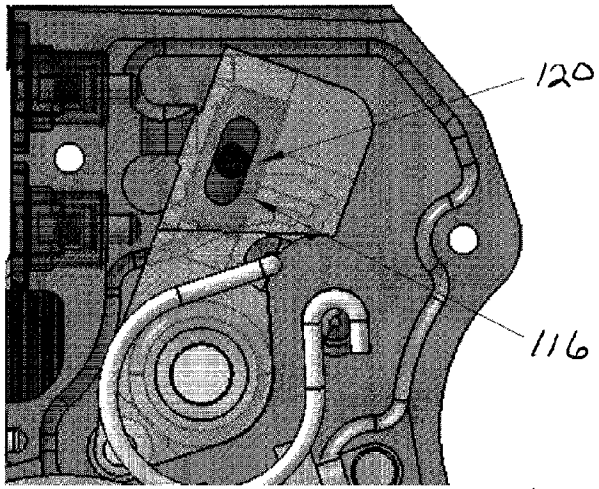
FIGS. 2A-2H are detail views of a first embodiment of the sequential firing with the trigger mechanism.
Figure 2D:
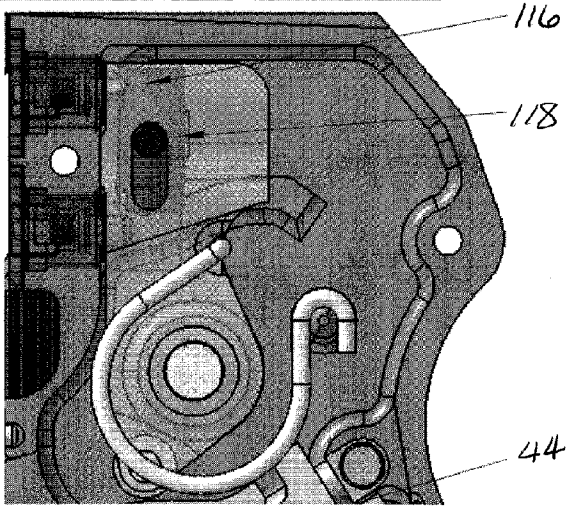
Figure 2A:
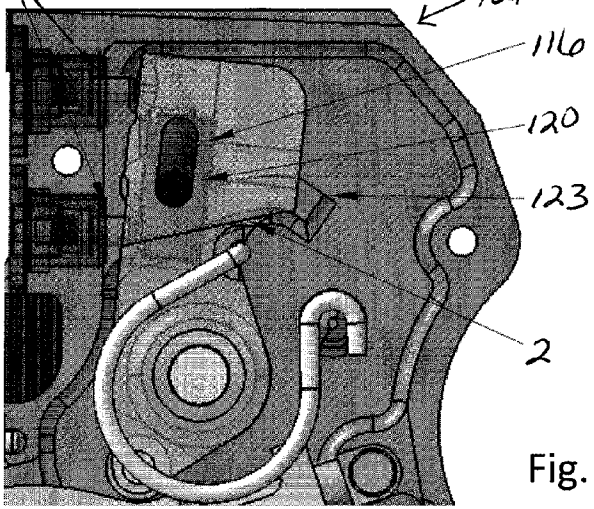
Figure 2C:
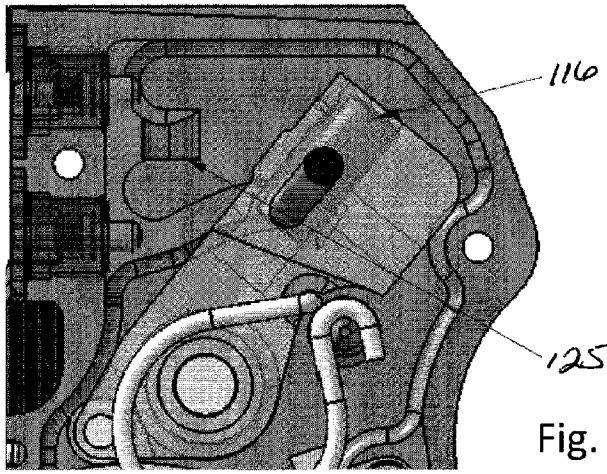
Figure 2F:
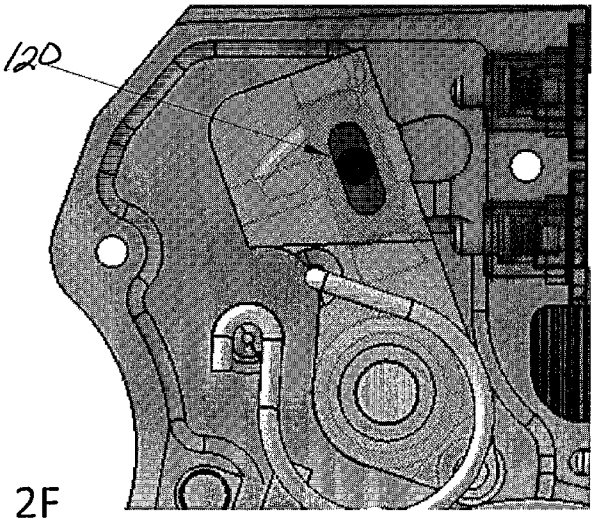
Figure 2H:
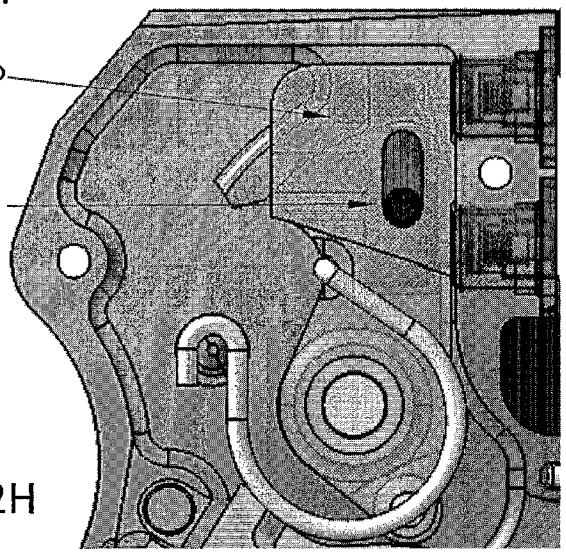
Figure 2E:
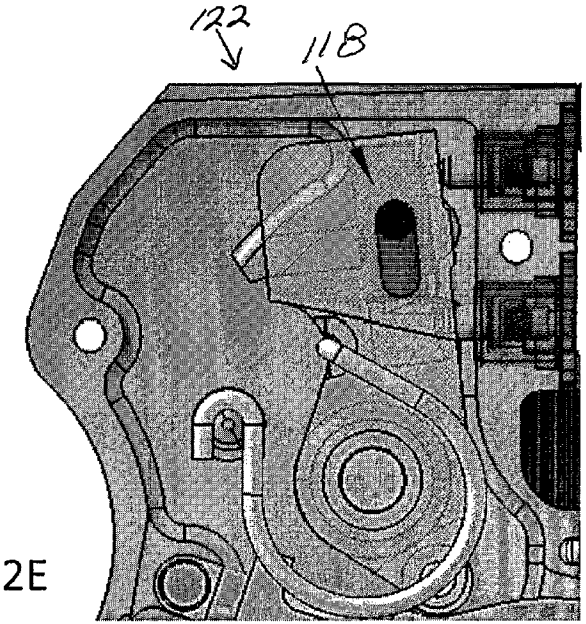
Figure 2G:
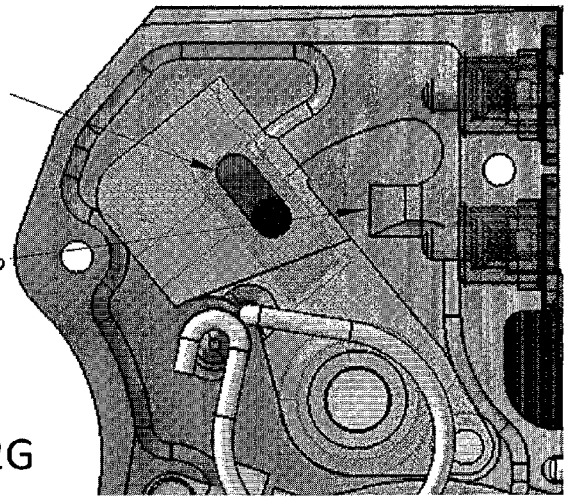
Figure 3B:
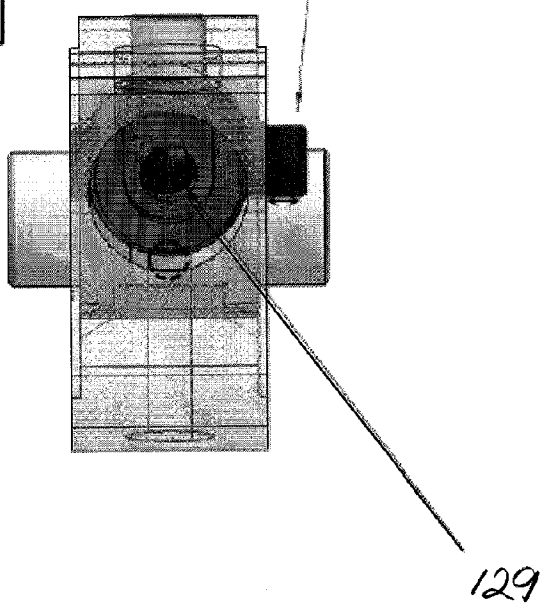
FIGS. 3A, 3B and 3C are detail views of the sequencing drum of a first embodiment of the present invention.
Figure 3C:
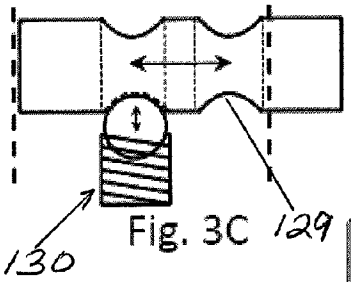
Figure 3A:
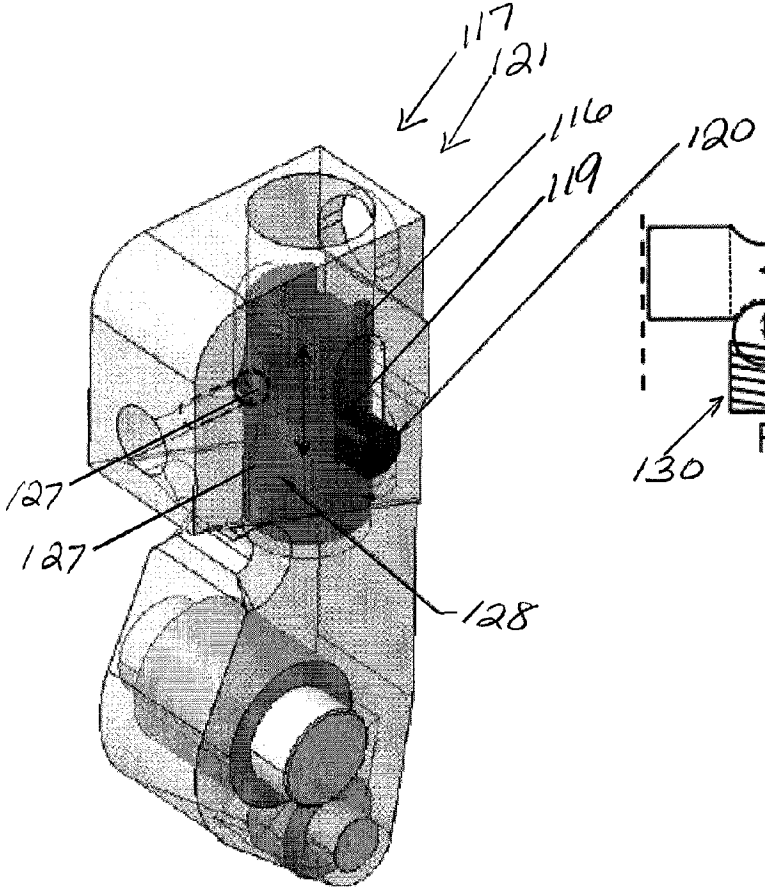

For both first and second embodiments, the operations of the sear assembly 3 and trigger pull 4 to move the hammer from its seated position, as shown in FIGS. 1A and 5A to its cocked position, as shown in FIG. 1D. The progression of movements is shown in FIGS. 1A-1I and 5A-5G. With the hammer in its cocked position, the trigger pull moves the sear assembly to the break point of the trigger mechanism, as shown in FIG. 1D. Any further movement of the trigger pull past the break point will push the supporting portion of the sear assembly off of a ledge 42 on the disconnect rest 41 to a disconnect position, thereby removing the support for the sear force that opposes the hammer spring force and causing the striking action as shown in FIGS. 1E-1G in which the hammer rotates from its cocked position and strikes the ammunition 36 at the breech plate. When the trigger finger force is removed from the trigger pull, the trigger return spring 37 and sear return spring 38 respectively bias the trigger pull and the sear assembly back to their rest position as shown in FIGS. 1A and 5A.

According to the general principles of the present invention, the sear translates along a longitudinal axis between the rest position and the break point position and then moves in an arc around a rotational axis from the break point position to a disconnect position. The sear has a hammer side 39 and a support side 40 opposite from the hammer side. As the sear translates along its longitudinal axis between the rest position and the break point position, the sear's hammer side presses against and rotates the cam end 9 of the hammer around the pivot point 6, thereby rotating the striking distal end of the hammer around the pivot point from the seated position to the cocked position. The support side 40 of the sear contacts the supporting face of the disconnect rest 41 as the sear translates between the rest position and the break point position. The support side has an edge 50 positioned proximate to the ledge 42 at the break point position. As indicated above, once the edge 50 moves past the ledge 42, the hammer spring 10 forces the sear from the break point position to its disconnect position and the hammer snaps back from the cocked position in its striking action.

The sear assembly preferably includes a wedge block 43 and a disconnect block 44 that each have a central passage that is positioned on and slides relative to a guide rod 45. The guide rod has a pivoting end 46 and a distal end 47 that can rotate relative to the pivoting end which is fixed to the frame 5. The wedge block is supported by the guide rod at its distal end, and is connected to the trigger pull through an arm 48 that has a rotating joint at each end. The disconnect block is positioned on the guide rod between the pivoting end and the wedge block and supports the other elements in the sear assembly, namely the guide rod which in turn supports the wedge block. When providing support to the sear assembly 3, the disconnect block 44 is positioned on the supporting face of the disconnect rest 41. The wedge block 43 includes a ramp surface 49 that is arranged at an acute angle relative to a guide plane 55 which is defined by the sear's longitudinal and rotational axes. The ramp surface is the hammer side of the sear that presses against and rotates the cam end of the hammer, thereby cocking the hammer. The wedge block also has a contact region that engages a side of the disconnect block as the hammer reaches the cocked position and preferably includes a cocked hammer surface 57 that is adjacent to the ramp surface and is arranged substantially parallel to the guide plane. In the preferred arrangement, there is no further rotation of the hammer as the hammer cam translates along the cocked hammer surface to the break point of the trigger mechanism.

The disconnect block 44 has a base surface 51 that contacts the supporting face 58 of the disconnect rest 41 and supports the guide rod 45 as the wedge block 43 is pushed by the trigger pull from its rest position to the break point position. In the preferred arrangement, the disconnect block remains stationary while the wedge block moves from the rest position to the point where the wedge block engages the disconnect block. This point of engagement between the blocks preferably coincides with the cocked hammer transition point at which the hammer cam moves from the wedge block's ramp surface 49 to its cocked hammer surface 57. The disconnect block can also include a catch face 52 that extends from the base surface 51 and engages the side face of the disconnect rest. The distance from the catch face 52 to the edge of the disconnect block defines the distance in which the wedge block pushes the disconnect block, namely from the engagement of the blocks to the trigger mechanism's break point and this distance can be calibrated to ensure the engagement of the blocks coincides with the cocked hammer transition point. Also, the disconnect block may have a slightly curved face that helps to position the disconnect block as it is pushed past the ledge and is forced into the disconnect position.

The hammer is pivotally supported by the frame, preferably by a pair of pivot bearings 53 on opposite sides of the hammer's pivot point 6 that attach to the frame's opposing side walls. In the preferred embodiment, the cam end of the trigger includes a roller bearing 59 that contacts the hammer side 39 of the sear. As the wedge block slides on the guide bar, the roller bearing 59 allows the hammer's cam end to roll along the ramp surface 49 and the cocked hammer surface 57.

At the break point of the trigger mechanism, the hammer is cocked and the wedge block has pushed the disconnect block so that the edge of the disconnect block 54 is at the ledge of the disconnect rest 42. Any further depression of the trigger pull to the firing position results in the wedge block pushing the edge of the disconnect block's base surface over the ledge. Without the engagement between the base surface 52 and the supporting face 58, there is no support for the sear components to oppose the hammer spring 10 which is fixed to the frame by a pin at one end and fixed to the hammer by another pin at its other end. Free from the opposing sear force, the hammer spring forces the components of the sear assembly into the disconnect position and produces the hammer's striking action. The sear assembly will not return to the rest position while the trigger pull remains in the firing position. When the pressure on the trigger pull is removed and it returns to its ready or rest position, the trigger return spring 37 and sear return spring 38 respectively bias the trigger pull and the sear assembly back to their rest position.

The arrangement of the sear assembly components provides an efficient way to cock and release the hammer followed by a quick return of the components into their rest position as the trigger pull returns to its ready position. It will be appreciated that changes could be made to the arrangement of the sear assembly components according to the overall teaching of the present invention.

It will be appreciated that the firing mechanism of the present invention is particularly applicable to breech loader firearms. However, this firing mechanism may be incorporated into any type of firearm or some other sequential triggering system.

It will also be appreciated that the firing mechanism of the present invention could be used for an upper-lower barrel design as particularly described above with reference to the illustrations or for a side-by-side barrel design. For a side-by-side arrangement, the index pin could be positioned from side to side within a transverse hollow core in the hammer. Rather than having the teeth at the top of the hammer, they would extend out of the side of the hammer, and the arm would engage the teeth accordingly.

The embodiments were chosen and described to best explain the principles of the invention and its practical application to persons who are skilled in the art. Various modifications could be made to the exemplary embodiments without departing from the scope of the invention, and it is intended that all matter contained herein shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. A sequential firing mechanism, comprising:

a hammer, wherein said hammer extends from a pivot point to a distal end, said hammer comprising a hollow core, a front face, a first side and a second side, wherein said front face comprises at least one hole extending between said front face and said hollow core, wherein said first side comprises a first slot, wherein said second side comprises a second slot, and wherein said hammer has a seated position and a cocked position;

a sequencing drum slidingly fitted in said hollow core of said hammer, wherein said sequencing drum comprises a bore and a follower pin slidingly fitted within said bore and extending beyond said bore and between said first slot and said second slot, wherein said sequencing drum has a first position and a second position and wherein said follower pin has a first side position with a first end extending beyond said first slot and a second side position with a second end extending beyond said second slot;

a first guide rail proximate to said first slot, wherein said first guide rail engages said first end of said pin when said sequencing drum is in said first position and forces said sequencing drum to said second position as said hammer is moved between its seated position and its cocked position; and a second guide rail proximate to said second slot, wherein said second guide rail engages said second end of said pin when said sequencing drum is in said second position and forces said sequencing drum to said first position as said hammer is moved between its seated position and its cocked position.

2. The invention of claim 1, wherein said front face further comprises a plurality of holes extending between said front face and said hollow core, wherein one of said holes is proximate to said first position of said sequencing drum and another of said holes is proximate to said second position of said sequencing drum.

3. The invention of claim 1, wherein said sequencing drum further comprises a pair of detents and said hammer further comprises a ball plunger, wherein a portion of said ball fits into one of said detents at said first position of said sequencing drum and fits into another of said detents at said second position of said sequencing drum.

4. The invention of claim 1, wherein said follower pin further comprises a pair of grooves and said sequencing drum further comprises a ball plunger, wherein a portion of said ball fits into one of said grooves at said first side position and fits into another of said grooves at said second side position.

5. The invention of claim 1, further comprising a first ramp and a second ramp proximate to said first slot and said second slot, respectively, wherein said first ramp engages said first end of said follower pin and pushes said follower pin from said first side position to said second side position as said hammer moves between said cocked position and said seated position and said sequencing drum is in said second position, and wherein said second ramp engages said second end of said follower pin and pushes said follower pin from said second side position to said first side position as said hammer moves between said cocked position and said seated position and said sequencing drum is in said first position.

6. The invention of claim 1 further comprising a breech plate with a pair of firing pins, wherein said front face of said hammer is situated against said breech plate when said hammer is in said seated position, wherein said first position of said sequencing drum engages one of said firing pins and said second position of said sequencing drum engages another of said firing pins.

7. A sequential firing mechanism, comprising:

a breech plate, wherein said breech plate comprises at least a pair of firing pins;

a hammer, wherein said hammer extends from a pivot point to a distal end, said hammer comprising a hollow core, at least one slot on a side of said hammer, and a front face with an exterior side and at least one hole extending from said exterior side to said hollow core, wherein said hammer has a seated position wherein said front face is adjacent to said breech plate and a cocked position rotated away from said breech plate;

a sequencing drum slidably fitted in said hollow core of said hammer, wherein said sequencing drum comprises at least one pin with an end extending through said slot; and at least one guide rail proximate to said slot in said hammer, wherein said guide rails engages said end of said pin and slides said sequencing drum in said hollow core from a first position to a second position.

8. The firing mechanism of claim 7, further comprising a another guide rail opposite said guide rail, wherein said hammer further comprises a second slot on an opposite side of said hammer, wherein said sequencing drum further comprises a bore, wherein said pin is slidingly fitted within said bore and extends beyond said bore and between said slot and said opposite slot, wherein said pin has a first side position with said end extending beyond said slot and a second side position with a second end extending beyond said opposite slot, and wherein said second guide rail engages said second end of said pin when said sequencing drum is in said second position and forces said sequencing drum to said first position as said hammer is moved between its seated position and its cocked position.

9. The firing mechanism of claim 8, further comprising a first ramp and a second ramp proximate to said slot and said second slot, respectively, wherein said first ramp engages said end of said pin and pushes said follower pin from said first side position to said second side position as said hammer moves between said cocked position and said seated position, and wherein said second ramp engages said second end of said pin and pushes said pin from said second side position to said first side position as said hammer moves between said cocked position.

10. The firing mechanism of claim 7, wherein said front face further comprises a pair of holes extending between said front face and said hollow core, wherein one of said holes is proximate to said first position of said sequencing drum and aligned with one of said firing pins and another of said holes is proximate to said second position of said sequencing drum and aligned with another of said firing pins.

11. The firing mechanism of claim 7, wherein said sequencing drum further comprises a pair of detents and said hammer further comprises a ball plunger, wherein a portion of said ball fits into one of said detents at said first position of said sequencing drum and fits into another of said detents at said second position of said sequencing drum.

12. The firing mechanism of claim 7, wherein said pin further comprises a pair of grooves and said sequencing drum further comprises a ball plunger, wherein a portion of said ball fits into one of said grooves at said first side position and fits into another of said grooves at said second side position.

13. A sequential firing mechanism, comprising:

a breech plate, wherein said breech plate comprises at least a pair of firing pins;

a hammer, wherein said hammer extends longitudinally from a pivot point to a distal end, said hammer comprising a longitudinally-extending hollow core and a front face with an exterior side and at least one hole extending from said exterior side to said hollow core, wherein said hammer has a seated position wherein said front face is adjacent to said breech plate and a cocked position rotated away from said breech plate;

an insert fitted in said hollow core of said hammer, wherein said insert has a protrusion extending out of said hollow core and moves from a first position to a second position within said hollow core; and an means for engaging said protrusion as said hammer rotates between said seated position and said cocked position, wherein said engaging means forces said insert between said first position and said second position.

14. The firing mechanism of claim 13, wherein said hole in said front face is further comprised a pair of holes, wherein one of said holes is proximate to said first position of said sequencing drum and aligned with one of said firing pins and another of said holes is proximate to said second position of said sequencing drum and aligned with another of said firing pins.

15. The firing mechanism of claim 13, wherein said hammer further comprises a first side and a second side, wherein said first side comprises a first slot, wherein said second side comprises a second slot, wherein said insert is a sequencing drum slidingly fitted in said hollow core, wherein said protrusion is a follower pin slidingly fitted within a bore in said sequencing drum, wherein said follower pin extends beyond said bore between said first slot and said second slot, wherein follower pin has a first side position with a first end extending beyond said first slot and a second side position with a second end extending beyond said second slot, wherein said engaging means is comprised of a first guide rail proximate to said first slot and a second guide rail proximate to said second slot, wherein said first guide rail engages said first end of said pin when said sequencing drum is in said first position and forces said sequencing drum to said second position as said hammer is moved between its seated position and its cocked position, and wherein said second guide rail engages said second end of said pin when said sequencing drum is in said second position and forces said sequencing drum to said first position as said hammer is moved between its seated position and its cocked position.

16. The firing mechanism of claim 15, further comprising a first ramp and a second ramp proximate to said first slot and said second slot, respectively, wherein said first ramp engages said first end of said follower pin and pushes said follower pin from said first side position to said second side position as said hammer moves between said cocked position and said seated position, and wherein said second ramp engages said second end of said follower pin and pushes said follower pin from said second side position to said first side position as said hammer moves between said cocked position.

17. The firing mechanism of claim 13, wherein said hollow core has a base end proximate to said pivot point of said hammer and an open end proximate to said distal end of said hammer, wherein said insert is an index pin rotatably fitted in said hollow core and comprising an inner end within said base end of said hollow core and an outer end at said open end of said hollow core, wherein said protrusion is at least one tooth extending from said outer end of said index pin beyond said open end of said hollow core, wherein said engaging means is comprised of a clocking arm extending from a proximal end to a distal tip, wherein said distal tip engages with said tooth as said hammer pivots between said seated position to said cocked position and rotates said index pin in said hollow core from a first clocked position to a second clocked position.

18. The firing mechanism of claim 17, further comprising a plurality of teeth extending from said outer end of said index pin, wherein said index pin further comprises a plurality of detents on said inner end and said hammer further comprises a spring fitted in a spring recess at said base end of said hollow core, and a ball situated between said inner end and said spring, wherein a portion of said ball fits into said detents as said index pin is rotated by said clocking arm.

19. The firing mechanism of claim 18, wherein said index pin has a groove around a circumference between said outer end and said inner end, wherein said hammer further comprises a pinhole extending from a side through to said hollow core and a retaining pin extending through said pinhole and into said groove, and wherein said clocking arm is angled from said proximal end toward said teeth at said distal tip.

20. The firing mechanism of claim 17, wherein said index pin further comprises first chamber and a second chamber, wherein a first striking pad in said first chamber is situated proximally to said hole in said first clocked position, a first void in said first chamber is situated proximally to said hole in said second clocked position, a second striking pad in said second chamber is situated proximally to said hole in said second clocked position, and a second void in said second chamber is situated proximally to said hole in said first clocked position.

* * * * *